US009775211B2

(12) United States Patent
Briggs

(10) Patent No.: US 9,775,211 B2
(45) Date of Patent: Sep. 26, 2017

(54) CIRCUIT AND APPARATUS FOR CONTROLLING A CONSTANT CURRENT DC DRIVER OUTPUT

(71) Applicant: ARKALUMEN INC., Ottawa (CA)

(72) Inventor: Gerald Edward Briggs, Ottawa (CA)

(73) Assignee: ARKALUMEN INC., Ottawa (CA)

( * ) Notice: Subject to any disclaimer, the term of this patent is extended or adjusted under 35 U.S.C. 154(b) by 0 days.

(21) Appl. No.: 15/052,873

(22) Filed: Feb. 24, 2016

(65) Prior Publication Data

US 2016/0330805 A1 Nov. 10, 2016

Related U.S. Application Data

(60) Provisional application No. 62/157,460, filed on May 5, 2015.

(51) Int. Cl.
*H05B 33/08* (2006.01)

(52) U.S. Cl.
CPC ..... *H05B 33/0851* (2013.01); *H05B 33/0818* (2013.01)

(58) Field of Classification Search
CPC ..... H05B 33/0851; H05B 33/0818
See application file for complete search history.

(56) References Cited

U.S. PATENT DOCUMENTS

| | | | |
|---|---|---|---|
| 4,593,234 | A | 6/1986 | Yang |
| 5,006,782 | A | 4/1991 | Pelly |
| 5,237,264 | A | 8/1993 | Moseley et al. |
| 5,248,919 | A | 9/1993 | Hanna et al. |
| 5,783,909 | A | 7/1998 | Hochstein |
| 5,803,579 | A | 9/1998 | Turnbull et al. |
| 5,932,995 | A | 8/1999 | Wagoner |
| 5,949,539 | A | 9/1999 | Britton, Jr. et al. |
| 6,069,905 | A | 5/2000 | Davis et al. |
| 6,127,798 | A | 10/2000 | Lansang et al. |
| 6,150,774 | A | 11/2000 | Mueller et al. |
| 6,175,195 | B1 | 1/2001 | Janczak et al. |
| 6,198,230 | B1 | 3/2001 | Leeb et al. |
| 6,222,352 | B1 | 4/2001 | Lenk |
| 6,307,331 | B1 | 10/2001 | Bonasia et al. |
| 6,351,079 | B1 | 2/2002 | Willis |
| 6,400,482 | B1 | 6/2002 | Lupton et al. |
| 6,426,599 | B1 | 7/2002 | Leeb |
| 6,441,558 | B1 | 8/2002 | Muthu |
| 6,445,139 | B1 | 9/2002 | Marshall et al. |
| 6,495,964 | B1 | 12/2002 | Muthu et al. |
| 6,504,633 | B1 | 1/2003 | Hovorka et al. |

(Continued)

FOREIGN PATENT DOCUMENTS

| | | |
|---|---|---|
| CN | 201220626 Y | 4/2009 |
| WO | WO-0113038 A1 | 2/2001 |

*Primary Examiner* — Jany Richardson
(74) *Attorney, Agent, or Firm* — Sean Murray; Murray IP Consulting Inc.

(57) ABSTRACT

The present invention is directed to circuit and apparatus for controlling an output of a constant current driver. A control apparatus is coupled between a constant current driver and a load, such as a lighting module, in order to add functionality to the overall system. The control apparatus is powered by the constant current driver and may control the dimming of the constant current driver by controlling the 0-10V dim input into the driver. The control apparatus may comprise one or more switching elements between the constant current driver and the load. The control apparatus may interface with external devices or communication networks in order to receive control commands or information that may be used for control purposes. Overall, the control apparatus is implemented into the system to enable added-value features that the constant current driver would otherwise not be able to implement.

25 Claims, 24 Drawing Sheets

(56) References Cited

U.S. PATENT DOCUMENTS 6,518,561 B1 2/2003 Miura
6,548,967 B1 4/2003 Dowling et al.
6,596,977 B2 7/2003 Muthu et al.
6,621,235 B2 9/2003 Chang
6,794,831 B2 9/2004 Leeb et al.
6,798,152 B2 9/2004 Rooke et al.
6,853,150 B2 2/2005 Clauberg et al.
6,894,442 B1 5/2005 Lim et al.
6,954,591 B2 10/2005 Lupton et al.
7,016,115 B1 3/2006 Leeb et al.
7,141,779 B1 11/2006 Chew et al.
7,233,115 B2 6/2007 Lys
7,256,554 B2 8/2007 Lys
7,265,681 B2 9/2007 Chen
7,321,203 B2 1/2008 Marosek
7,352,135 B2 4/2008 Shiotsu et al.
7,457,089 B2 11/2008 Ohshima
7,486,032 B2 2/2009 Lee
7,495,425 B2 2/2009 Friedrich
7,498,754 B2 3/2009 Masood
7,511,463 B2 3/2009 Kumar
7,633,577 B2 12/2009 Moon et al.
7,649,326 B2 1/2010 Johnson et al.
7,683,470 B2 3/2010 Lee et al.
7,683,504 B2 3/2010 Blair et al.
7,750,616 B2 7/2010 Liu
7,759,881 B1 7/2010 Melanson
7,847,783 B2 12/2010 Liu et al.
8,105,854 B2 1/2012 Lee et al.
8,193,737 B2 6/2012 Peker et al.
8,232,742 B2 7/2012 Briggs
8,247,975 B2 8/2012 Yoo et al.
8,248,439 B2 8/2012 Ran et al.
8,324,834 B2 12/2012 Wang et al.
8,358,085 B2 1/2013 Catalano et al.
8,587,203 B2 11/2013 Chen et al.
8,681,192 B2 3/2014 Inoue et al.
8,766,162 B2 7/2014 Tanase
8,848,202 B2 9/2014 Dyer et al.
8,941,308 B2 1/2015 Briggs
9,089,024 B2 7/2015 Briggs et al.
9,204,511 B2 12/2015 Esaki et al.
9,217,557 B2 12/2015 Briggs
9,345,109 B2 5/2016 Briggs
9,347,631 B2 5/2016 Briggs
2004/0119602 A1 6/2004 Blum et al.
2004/0263093 A1 12/2004 Matsubayashi et al.
2005/0127888 A1 6/2005 Marschalkowski et al.
2005/0156644 A1 7/2005 Karnahan et al.
2005/0173924 A1 8/2005 French
2005/0199841 A1 9/2005 O'Maley et al.
2005/0213353 A1 9/2005 Lys
2005/0225264 A1 10/2005 Kemp
2005/0269580 A1 12/2005 D'Angelo
2006/0044800 A1 3/2006 Reime
2006/0049782 A1 3/2006 Vornsand et al.
2006/0113975 A1 6/2006 Mednik et al.
2006/0239689 A1 10/2006 Ashdown
2007/0080911 A1 4/2007 Liu et al.
2007/0103086 A1 5/2007 Neudorf et al.
2007/0103832 A1 5/2007 Ohshima
2007/0159421 A1 7/2007 Peker et al.
2007/0182338 A1 8/2007 Shteynberg et al.
2007/0195552 A1 8/2007 Park
2007/0229047 A1 10/2007 Sigamani et al.
2007/0267978 A1 11/2007 Shteynberg et al.
2007/0268028 A1 11/2007 Moyer et al.
2007/0278974 A1 12/2007 Van De Ven
2008/0079705 A1 4/2008 Yang et al.
2008/0088769 A1 4/2008 Kim et al.
2008/0138085 A1 6/2008 Lin et al.
2008/0150449 A1 6/2008 Wang et al.
2008/0180040 A1 7/2008 Prendergast et al.
2008/0191642 A1 8/2008 Slot et al.
2008/0224636 A1 9/2008 Melanson
2008/0238341 A1 10/2008 Korcharz et al.
2008/0252664 A1 10/2008 Huang et al.
2008/0272277 A1 11/2008 Wei
2009/0027652 A1 1/2009 Chang et al.
2009/0096392 A1 4/2009 Chandran et al.
2009/0134817 A1 5/2009 Jurngwirth et al.
2009/0160422 A1 6/2009 Isobe et al.
2009/0167194 A1 7/2009 Mizuta
2009/0174337 A1 7/2009 Miskin et al.
2009/0195168 A1 8/2009 Greenfeld
2009/0195183 A1 8/2009 Yang
2009/0251059 A1 10/2009 Veltman
2009/0251071 A1 10/2009 Gater et al.
2009/0322252 A1 12/2009 Shiu et al.
2010/0019692 A1 1/2010 Kimura
2010/0033146 A1 2/2010 Irissou et al.
2010/0033150 A1 2/2010 Irissou et al.
2010/0046210 A1 2/2010 Mathai et al.
2010/0060187 A1 3/2010 Newman et al.
2010/0066266 A1 3/2010 Huang et al.
2010/0066484 A1 3/2010 Hanwright et al.
2010/0072899 A1 3/2010 Engstrand
2010/0072902 A1 3/2010 Wendt et al.
2010/0079124 A1 4/2010 Melanson
2010/0100253 A1 4/2010 Fausek et al.
2010/0102230 A1 4/2010 Chang et al.
2010/0117450 A1 5/2010 Azrai et al.
2010/0156319 A1 6/2010 Melanson
2010/0164406 A1 7/2010 Kost et al.
2010/0171429 A1 7/2010 Garcia et al.
2010/0171442 A1 7/2010 Draper et al.
2010/0177127 A1 7/2010 Akiyama et al.
2010/0194308 A1 8/2010 Zhao et al.
2010/0245289 A1 9/2010 Svajda
2010/0264834 A1 10/2010 Gaines et al.
2010/0277075 A1 11/2010 Rees
2010/0289424 A1 11/2010 Chang et al.
2010/0302477 A1 12/2010 Ohmi et al.
2010/0320936 A1 12/2010 Yao
2010/0320939 A1 12/2010 Lai
2011/0006691 A1 1/2011 Blaha et al.
2011/0050130 A1 3/2011 Rudolph
2011/0068703 A1 3/2011 McKinney
2011/0086676 A1 4/2011 Choi et al.
2011/0101950 A1 5/2011 Babb
2011/0115394 A1 5/2011 Shteynberg et al.
2011/0115412 A1 5/2011 Welten
2011/0187313 A1 8/2011 Lee
2011/0193489 A1 8/2011 Moss
2011/0194047 A1 8/2011 Bruyneel et al.
2011/0227492 A1 9/2011 Du et al.
2011/0279040 A1 11/2011 Briggs et al.
2011/0279048 A1 11/2011 Briggs
2011/0279053 A1 11/2011 Briggs
2011/0279055 A1 11/2011 Briggs
2011/0279057 A1 11/2011 Briggs
2011/0298386 A1 12/2011 Corradi
2012/0146519 A1 6/2012 Briggs
2012/0262071 A1 10/2012 Briggs
2012/0262076 A1 10/2012 Briggs
2012/0268019 A1 10/2012 Briggs
2012/0312956 A1 12/2012 Chang et al.
2012/0320626 A1 12/2012 Quilici et al.
2013/0009561 A1 1/2013 Briggs
2013/0015774 A1 1/2013 Briggs
2013/0170263 A1* 7/2013 Newman, Jr. ..... H02M 7/06 363/126
2013/0223058 A1 8/2013 Briggs
2013/0293722 A1 11/2013 Chen
2013/0297251 A1 11/2013 Engel-Hall et al.
2013/0300316 A1 11/2013 Engel-Hall et al.

* cited by examiner

CIRCUIT AND APPARATUS FOR CONTROLLING A CONSTANT CURRENT DC DRIVER OUTPUT

CROSS-REFERENCE TO RELATED APPLICATION

The present application claims the benefit under 35 USC 119(e) of U.S. Provisional Patent Application 62/157,460 filed on May 5, 2015 and hereby incorporated by reference herein.

FIELD OF THE INVENTION

The invention relates generally to driver control systems and, more particularly, to circuits and apparatus for controlling a constant current DC driver output.

BACKGROUND

Light Emitting Diodes (LEDs) are increasingly being adopted as general illumination lighting sources due to their high energy efficiency and long service life relative to traditional sources of light such as incandescent, fluorescent and halogen. Each generation of LEDs are providing improvements in energy efficiency and cost per lumen, thus allowing for lighting manufacturers to produce LED light fixtures at increasingly competitive prices.

With the exception of relatively limited AC LED modules, LED modules typically operate using DC power with the current flowing through the LEDs dictating the lumens produced. In a typical LED light fixture, an AC to DC driver is implemented to convert AC power from the power grid to DC power that can be used to power the LEDs. In some cases, a constant voltage driver is used which will maintain a particular DC voltage. This architecture can work if the DC voltage of the driver is matched perfectly with the LED modules being used to ensure an appropriate current will flow through the LEDs to produce the desired output light intensity. Perfectly matching the DC voltage output of a constant voltage driver with a particular forward voltage for a series of LEDs is not simple and could add complexity to the design of the LED modules. Further, fluctuations in the forward voltage of LEDs will occur if thermal temperature changes occur and long wires used to connect the LED modules may increase voltage drops. These fluctuations will result in load requirements changing while the constant voltage driver maintains the same voltage output, thus causing fluctuations in the current flowing through the LEDs. The result of this situation is an inconsistent light output intensity which is not desired.

To overcome the problems with the use of constant voltage drivers with LEDs, it has become typical for light fixtures to be designed using AC to DC drivers that are constant current drivers. The constant current drivers, as their name indicates, output a constant current to the attached LED modules as long as the load has an operating voltage range within the acceptable limits of the driver. For instance, a constant current driver may be set to 700 mA with an operating voltage range of 12-24V. In this case, LED modules with a forward voltage of 21V will operate with a current of 700 mA. Typical constant current drivers use a feedback control mechanism to adjust the output voltage between a high power rail and a low power rail depending upon the current that is detected.

Due to their popularity in LED light fixtures, constant current drivers are decreasing in cost at a fast rate and becoming a commodity product. Key differentiators of different constant current drivers are their efficiency, wattage and flexibility. In terms of flexibility, some designs for constant current drivers allow for their output current to be programmed in using a programming tool (either wired or wireless). In some cases, a plurality of different outputs with different current levels may be output from the constant current drivers.

One control feature that is offered increasingly as a standard control feature within constant current drivers is 0-10V dimming. 0-10V dimming is a system that typically interfaces with a wall mounted dimmer and allows a user to adjust the output current of the constant current driver and therefore the light intensity of the light fixture that the constant current driver is implemented. In normal implementations, the wall mounted dimmer acts effectively as a variable resistor and the constant current driver provides a very small current between grey and purple dimming wires that connect through the dimmer to detect a voltage drop. The level of the voltage drop can determine a desired dim level for the constant current driver. As a result, the constant current driver can adjust the desired output current to be provided to attached LED modules.

A problem with the commoditization of the constant current drivers is that there is little development on how to implement advanced control features using these simple AC to DC converters. Technologies have developed in lighting to allow for a wide range of control features to lower energy usage, increase user experience and/or communicate information to/from light fixtures. None of these features can easily be implemented using the simple constant current drivers that are becoming the standard components in LED light fixtures.

Against this background, there is a need for solutions that will mitigate at least one of the above problems, particularly enabling additional control features to be implemented using standard constant current drivers.

SUMMARY OF THE INVENTION

According to a first broad aspect, the present invention is a control apparatus adapted to be coupled to a power source operable to generate a voltage across first and second nodes to maintain a particular current level flowing through a load coupled between the first and second nodes. The particular current level is determined at least in part by a detected resistance between third and fourth nodes within the power source. The control apparatus comprises: a voltage control module and a control module. The voltage control module is adapted to be coupled to the first and second nodes and operable to generate a controlled voltage independent of the voltage generated by the power source across the first and second nodes. The control module is powered by the controlled voltage, adapted to be coupled to the third and fourth nodes, operable to generate a perceived resistance between the third and fourth nodes. The control module at least in part controls the particular current level set by the power source flowing through the load coupled between the first and second nodes.

In some embodiments, the voltage control module comprises a voltage regulator with a maximum input voltage equal to or greater than a maximum voltage output by the power source across the first and second nodes and the second node acts as a virtual ground for the control apparatus. The voltage control module may further comprise a capacitor coupled between an output of the voltage regulator and the second node. The control module, in some embodiments, comprises an opto isolation element adapted to be coupled between the third and fourth nodes and operable to generate the perceived resistance between the third and fourth nodes. The opto isolation element may comprise an LED and a phototransistor adapted to be coupled between the third and fourth nodes and the control module may be operable to generate a controlled current through the LED, whereby the phototransistor generates the perceived resistance between the third and fourth nodes in response to a light level from the LED dictated by the controlled current. The control module may further comprise a signal generator operable to generate a control signal and a current control module to generate the controlled current through the LED in response to the control signal. In some implementations, the current control module comprises a buck converter and the control signal is a pulse width modulation signal that controls the buck converter. The signal generator may receive an indication of the current flowing through the LED and generate the control signal at least in part in response to the indication of the current flowing through the LED.

In some embodiments, the control module receives an external control signal from a user interface device and generates the perceived resistance between the third and fourth nodes in response to the external control signal. The external control signal may be received via infrared and the user interface device may be an infrared remote control device. Further, the external control signal may be received via one of a DMX protocol, ZigBee protocol and DALI protocol system. In some embodiments, the control module receives at least one of an indication of motion and an indication of occupancy and generates the perceived resistance between the third and fourth nodes in response to the at least one of the indication of motion and the indication of occupancy. In response to receiving at least one of the indication of motion and the indication of occupancy, the control module may be operable to generate a change in the perceived resistance between the third and fourth nodes in order to increase the particular current set by the power source. Further, in response to not receiving at least one of the indication of motion and the indication of occupancy for a predetermined time, the control module may be operable to generate a change in the perceived resistance between the third and fourth nodes in order to decrease the particular current set by the power source.

In various embodiments of the present invention, the control apparatus further comprises a switching element adapted to be coupled between the power source and the load, the switching element operable to connect the power source and the load during a first state and to disconnect the power source and the load during a second state. The control module may control the state of the switching element and dictate whether the switching element is in the first or second state. The first and second nodes may be coupled to high and low power outputs respectively of the power source and the switching element may be an N-channel transistor coupled between the second node and the load. Alternatively, the first and second nodes may be coupled to high and low power outputs respectively of the power source and the switching element may be a P-channel transistor coupled between the first node and the load. In some implementations, the control module may receive at least one of an indication of motion and an indication of occupancy and controls the state of the switching element in response to the at least one of the indication of motion and the indication of occupancy. In response to receiving at least one of the indication of motion and the indication of occupancy, the control module may be operable to control the switching element to be in the first state. Further, in response to not receiving at least one of the indication of motion and the indication of occupancy for a predetermined time, the control module may be operable to control the switching element to be in the second state.

In some embodiments, the control module may comprise a light sensor and the control module may be operable to control the switching element to be in the first state for a first period of time and to be in the second state for a second period of time; to measure light using the light sensor during the second period of time; and generate the perceived resistance between the third and fourth nodes at least in part in response to the measured light during the second time period. The control module may control the switching element to be in the first state substantially longer than the second state, whereby the power source is not substantially affected by the switching of the switching element.

According to a second broad aspect, the present invention is an apparatus comprising a power source and a control apparatus. The power source is operable to generate a voltage across first and second nodes to maintain a particular current level flowing through a load coupled between the first and second nodes. The particular current level is determined at least in part by a detected resistance between third and fourth nodes within the power source. The control apparatus is adapted to be coupled to the first and second nodes and operable to generate a controlled voltage independent of the voltage generated by the power source across the first and second nodes. The control apparatus comprises a control module powered by the controlled voltage and adapted to be coupled to the third and fourth nodes, the control module operable to generate a perceived resistance between the third and fourth nodes. The control module at least in part controls the particular current level set by the power source flowing through the load coupled between the first and second nodes.

According to a third broad aspect, the present invention is an apparatus comprising a lighting apparatus comprising a lighting module coupled between first and second nodes, a power source and a control apparatus. The power source is operable to generate a voltage across the first and second nodes to maintain a particular current level flowing through the lighting module. The particular current level is determined at least in part by a detected resistance between third and fourth nodes within the power source. The control apparatus is adapted to be coupled to the first and second nodes and operable to generate a controlled voltage independent of the voltage generated by the power source across the first and second nodes. The control apparatus comprises a control module powered by the controlled voltage and adapted to be coupled to the third and fourth nodes, the control module operable to generate a perceived resistance between the third and fourth nodes. The control apparatus at least in part controls the particular current level set by the power source flowing through the lighting module.

According to a fourth broad aspect, the present invention is an apparatus comprising a control apparatus adapted to be coupled to a power source comprising first and second output nodes. The power source is operable to control a voltage across the first and second output nodes to maintain a constant current level flowing through a load coupled between the first and second output nodes. The control apparatus comprises a voltage control module, a control module and a switching element. The voltage control module is adapted to be coupled to the first and second output nodes and operable to generate a controlled voltage independent of the voltage generated by the power source across the first and second nodes. The control module is powered by the controlled voltage and operable to receive an input control signal and generate an output control signal in response to the input control signal. The switching element is adapted to be coupled between the power source and the load, the switching element operable to be activated and deactivated in response to the output control signal generated by the control module.

These and other aspects of the invention will become apparent to those of ordinary skill in the art upon review of the following description of certain embodiments of the invention in conjunction with the accompanying drawings.

BRIEF DESCRIPTION OF THE DRAWINGS

A detailed description of embodiments of the invention is provided herein below, by way of example only, with reference to the accompanying drawings, in which.

It is to be expressly understood that the description and drawings are only for the purpose of illustration of certain embodiments of the invention and are an aid for understanding. They are not intended to be a definition of the limits of the invention.

DETAILED DESCRIPTION OF EMBODIMENTS

The present invention is directed to circuit and apparatus for controlling an output of a constant current driver. A control apparatus is coupled between a constant current driver and a load, such as a lighting module, in order to add functionality to the overall system. The control apparatus is powered by the constant current driver and may control the dimming of the constant current driver by controlling the 0-10V dim input into the driver. The control apparatus may comprise one or more switching elements between the constant current driver and the load. The control apparatus may interface with external devices or communication networks in order to receive control commands or information that may be used for control purposes. Overall, the control apparatus is implemented into the system to enable added-value features that the constant current driver would otherwise not be able to implement.

The embodiments described are directed to implementations of constant current drivers that power lighting modules and lighting modules implemented with Light Emitting Diodes (LEDs) in particular. It should be understood that the addition of a control apparatus to a constant current driver as described could be implemented in other technology areas and the scope of the present invention should not be limited to lighting modules and LED lighting modules in particular. Other loads, including potentially other lighting components, that require a constant current input could benefit from the added control features that may be enabled with the control apparatus of the present invention.

Figure 1A:
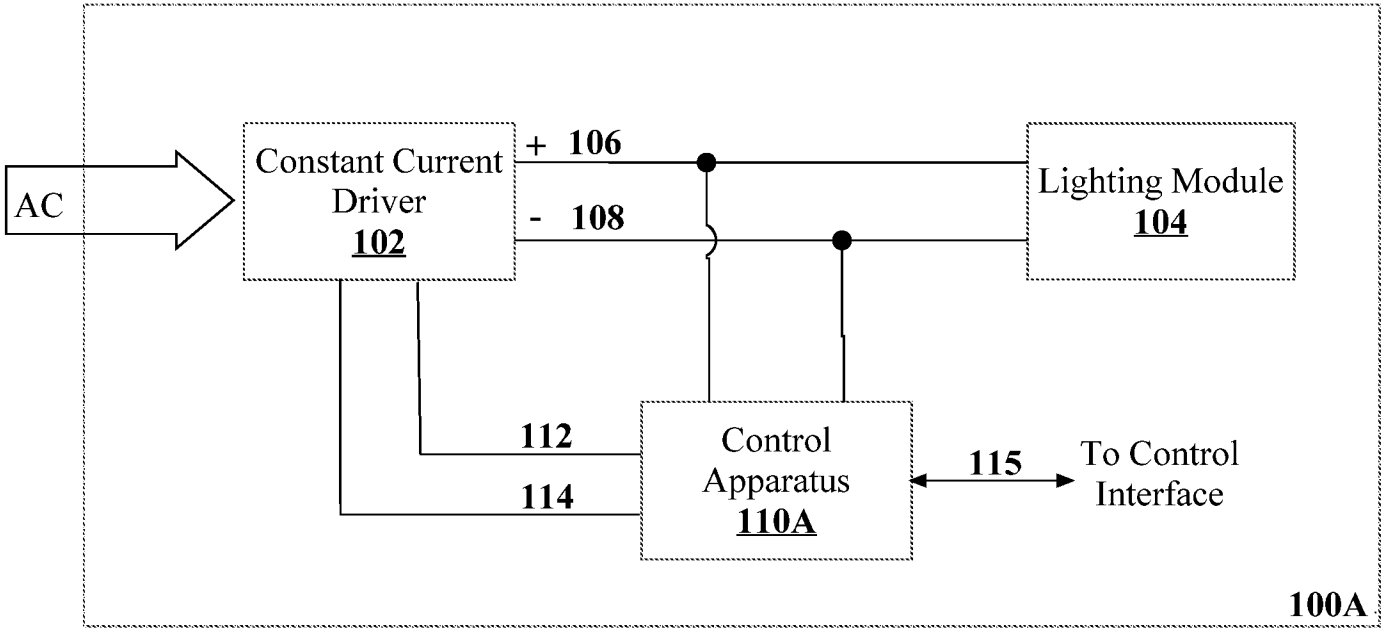
FIGS. 1A to 1E are block diagrams of a lighting apparatus including control apparatus according to various embodiments of the present invention.

FIGS. 1A to 1E are block diagrams of lighting apparatus 100A, 100B, 100C, 100D, 100E including control apparatus 110A, 110B, 110C, 110D, 110E respectively according to various embodiments of the present invention. As depicted in FIG. 1A, lighting apparatus 100A comprises a constant current driver 102 coupled to a lighting module 104 via positive and negative rails 106, 108. The lighting apparatus 100A further comprises a control apparatus 110A also coupled to the positive and negative rails 106, 108 and further coupled to dimming inputs 112, 114 of the constant current driver 102 and to a control interface via connection 115.

The constant current driver 102 may take many forms with various wattages, current settings or other technical specifications. Constant current drivers are well known and are utilized extensively in lighting apparatus. The constant current driver 102 of FIG. 1A has inputs connected to an AC power source such as the power grid and has positive and negative terminals that connect to positive rail 106 and negative rail 108 respectively. When the rails 106, 108 are coupled to a load, the constant current driver 102 adjusts the voltage across the positive and negative rails 106, 108 in order to attempt to maintain a particular current through the load. The constant current driver 102 will typically have a high and low voltage limit for adjusting the voltage to across the positive and negative rails 106, 108. The actual voltage across the positive and negative rails 106, 108 to achieve the particular current through the load depends upon the load. In some cases, even at the maximum voltage limit for the constant current driver 102, the load will not draw sufficient current to achieve the particular current for the constant current driver 102. In this case, the voltage across the positive and negative rails 106, 108 will be at the maximum voltage limit and the current through the load may be lower than the particular current for the constant current driver 102. In other cases, even at the minimum voltage limit for the constant current driver 102, the load would draw a higher current than the particular current for the constant current driver 102. In this case, the constant current driver 102 may go into a safety mode and turn off, thus preventing a short circuit condition across the positive and negative rails 106, 108.

The constant current driver 102 further has two dimming terminals coupled to nodes 112, 114. The dimming terminals, in normal operation, could be standard 0-10V dimming terminals that typically would be used to connect to an off-the-shelf 0-10V dimming apparatus such as a wall mounted dimmer. In normal operation, the 0-10V dimming apparatus would be implemented between the dimming terminals and set a variable resistance between the dimming terminals. The constant current driver 102 can measure the voltage drop across the dimming terminals and use this voltage drop as an indication of the setting of the 0-10V dimming apparatus and the desired dim level for the driver 102. The constant current driver 102 can then adjust the particular current output from the driver 102 based on the measured voltage drop across the dimming terminals. In this architecture, the dimming terminals may be associated with purple and grey wires. In other embodiments, other dimming architectures could be used that enable the driver 102 to receive indications of a dimming level from a user.

Figure 2A:
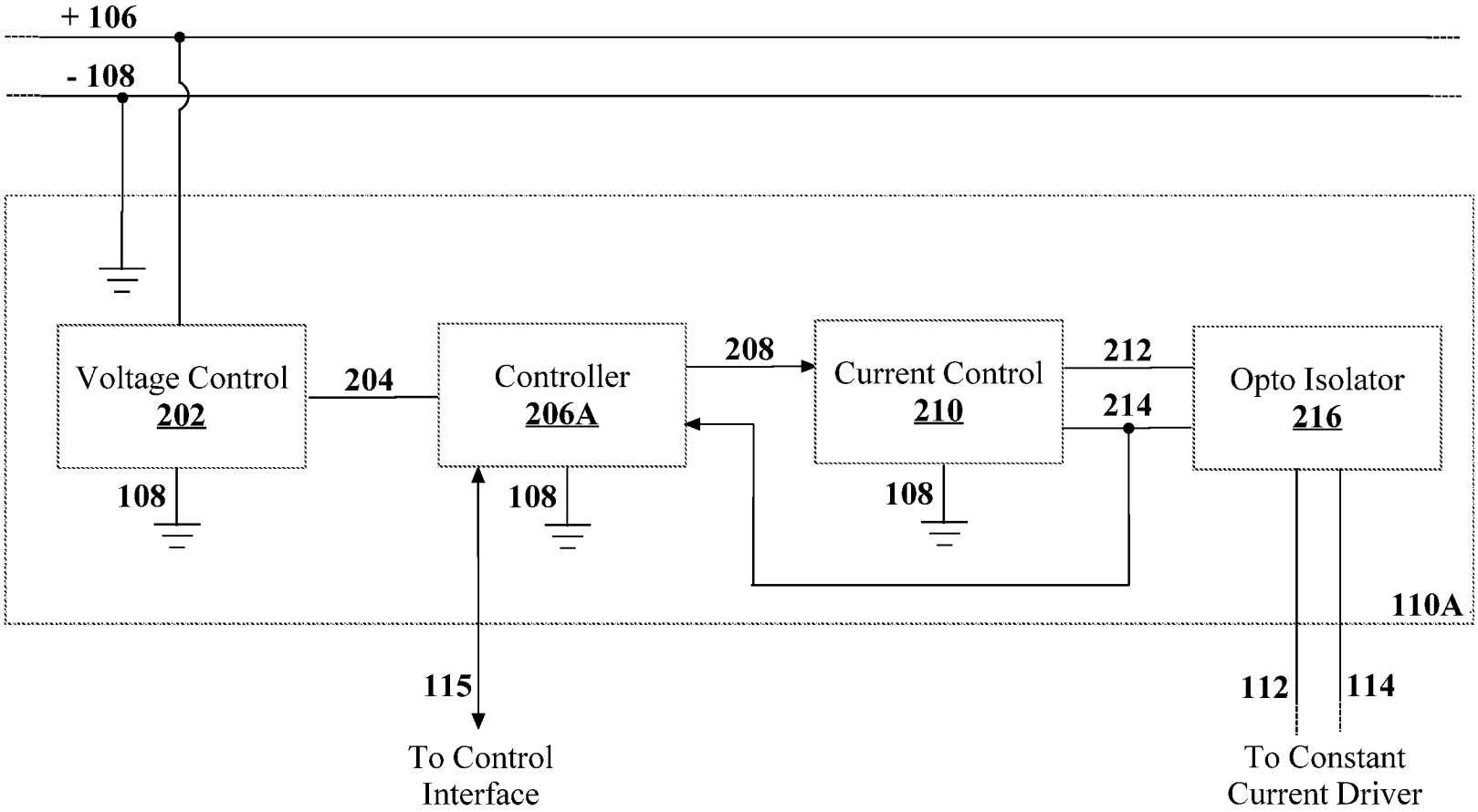
FIGS. 2A to 2D are block diagrams of the control apparatus of FIGS. 1A to 1D according to various embodiments of the present invention.

The lighting module 104 may be implemented in a wide variety of different manners. In one case, the lighting module 104 may comprise a plurality of sets of LEDs coupled in parallel, each set of LEDs comprising a plurality of LEDs. In one particular implementation, the lighting module 104 may be designed to operate at 21-24V and comprise a plurality of parallel sets of seven LEDs in series. In another implementation, the lighting module 104 may be designed to operate at a different forward voltage such as 12V, 30V, 48V, 60V or any other voltage as may be preferred. For the constant current driver 102 to operate properly with the lighting module 104, the forward voltage of the lighting module 104 should be between the minimum and maximum voltage limits for the constant current driver 102. It should be understood that other architectures for a lighting module 104 may be implemented such as a lighting module not using LEDs or a lighting module that includes additional components than only LEDs. For instance, resistors, diodes and/or switches may be implemented within the lighting module 104. The control apparatus 110A according to one embodiment of the present invention is illustrated in FIG. 2A. As shown, the control apparatus 110A comprises a voltage control module 202 coupled to the positive and negative rails 106, 108 that outputs a controlled voltage on line 204 to a controller 206A. The controller 206A is grounded by the negative rail 108 and outputs a control signal on node 208 to a current control module 210. The controller 208 may further interface with a control interface via connection 115. The control apparatus 110A further comprises a current control module 210 that receives the control signal on node 208 and sets a particular current to flow from node 212 to node 214 and an opto isolator 216 that generates a virtual resistance between nodes 112, 114 based upon the current flowing from node 212 to node 214. The controller 206A further has a feedback input connected to node 214 in order to determine the particular current flowing from node 212 to node 214.

Figure 4B:
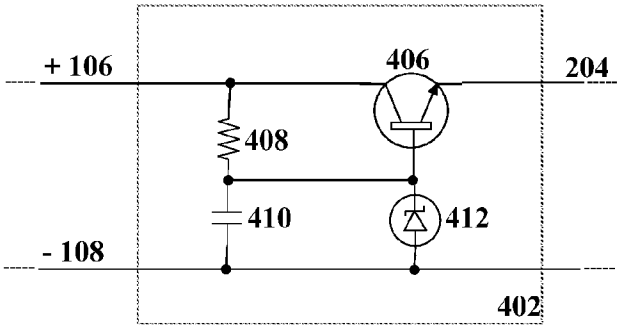
FIG. 4B is a sample circuit diagram of a voltage controller of the voltage control apparatus of FIG. 4A.
Figure 4A:
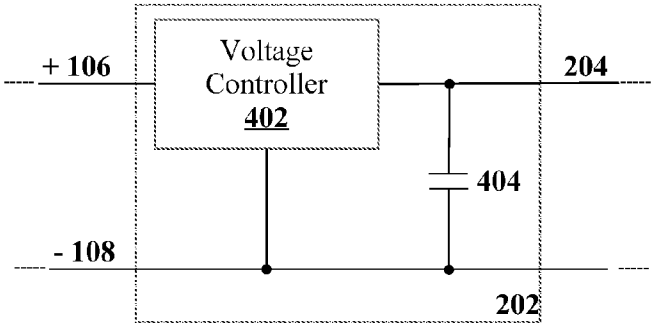
FIG. 4A is a sample circuit diagram of a voltage control apparatus of the control apparatus of FIGS. 2A to 2D.

The voltage control module 202 is operable to manage a wide range of input voltages across the positive and negative rails 106, 108 and outputs the controlled voltage on line 204 independent of the voltage across the positive and negative rails 106, 108. The voltage control module 202 in some embodiments may output a 5V output to the controller 206A. In one embodiment as depicted in FIG. 4A, the voltage control module 202 may comprise a voltage regulator 402 and a capacitor 404 coupled between the line 204 and the negative rail 108. The capacitor 404 is operable to stabilize the output of the voltage regulator 402 and ensure a more controlled voltage on line 204 independent of the voltage across the positive and negative rails 106, 108. In one embodiment, the capacitor 404 may be set to a value of 1 μF.

In the design of FIG. 1A, the voltage control module 202 may be designed to be input with voltages up to the maximum forward voltage of the lighting module 104. In other embodiments as will be described with FIG. 1B to 1E, it is important for the voltage control module 202 to be capable to input voltages up to the maximum limit of the voltage output from the constant current driver 102. If the lighting module 104 is disconnected from the constant current driver 102 and the only load on the constant current driver 102 is the control module 106A or similar, the constant current driver 102 may output its maximum voltage limit in an attempt to output the particular current for the driver 102. The voltage control module 202 should be designed to be able to input this maximum voltage limit.

The voltage regulator 402 may comprise an LDO regulator though may be implemented in a different manner. For instance, the voltage regulator 402 may comprise a low loss buck converter (not shown). In some embodiments, the voltage regulator 402 may comprise discrete components. In the case depicted in FIG. 4B, the voltage regulator 402 comprises an NPN bipolar junction transistor 406 implemented with its collector coupled to the positive rail 106, its emitter coupled to the line 204, and its base coupled via a resistor 408 to the positive rail 106 and to the negative rail 108 via a capacitor 410. Further, the voltage regulator 402 of FIG. 4B comprises a zener diode 412 with its anode coupled to the negative rail 108 and its cathode coupled to the base of the transistor 406. Using the voltage regulator 402 of FIG. 4B may allow for a more flexible design than using an off-the-shelf voltage regulator chip. In particular, the values, power capacities, voltage limitations and/or tolerances of the discrete components utilized within the voltage regulator 402 of FIG. 4B may be selected to ensure the voltage control module 202 can manage the range of voltages potentially output from the constant current driver 102, including the maximum voltage limit for the constant current driver 102. In one implementation, the resistor 408 may have a value of 2 kΩ with a 1 W or higher power capacity and the capacitor 410 may be a 50V 1 μF ceramic capacitor. It should be understood that other values for components could be used and other architectures for a voltage regulator could be used to generate a particular voltage on line 204.

The controller 206A may be implemented as a microcontroller that operates at a controlled voltage such as 5V (or other voltages such as 3V) and outputs a variable Pulse Width Modulation (PWM) signal as the control signal on node 208. The controller 206A may receive information or commands from a control interface (not shown) via connection 115. Various different potential control interfaces will be described with reference to FIG. 5A. In various implementations, the controller 206A may receive information via the connection 115 including but not limited to: motion sense information, occupancy sense information, measured light level information, ambient light information, measured light color/color temperature information, humidity information, accelerometer information, geo-positioning information, audio information, infrared remote commands, dimming apparatus interfaces, signals over visible light, and data input from a communication protocol such as DMX, DALI, Zwave, ZigBee (including but not limited to ZigBee Home Automation and Zigbee Light Link), Bluetooth and Bluetooth Low Energy, WIFI, or other protocols.

Figure 4C:
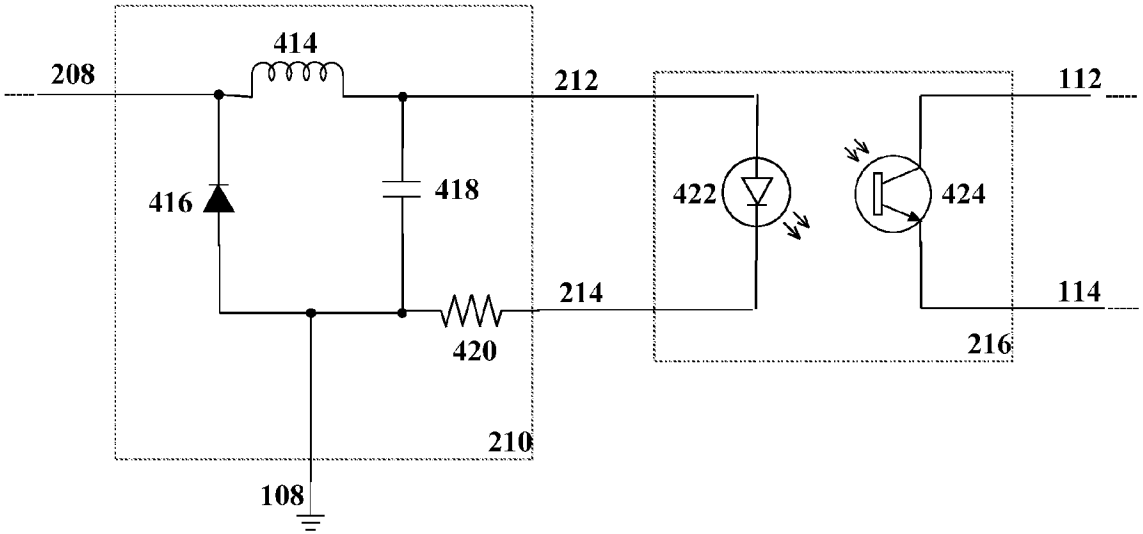
FIG. 4C is a sample circuit diagram of a current control apparatus and opto isolator apparatus of the control apparatus of FIGS. 2A to 2D.

The current control module 210 is operable to generate a particular current from node 212 to node 214 which the opto isolator 216 converts to a virtual resistance between nodes 112 and 114. FIG. 4C illustrates an implementation of the current control module 210 and the opto isolator 216 according to one embodiment of the present invention. As shown, the current control module 210 may comprise an inductor 414 coupled between node 208 and node 212, a diode 416 having its anode coupled to the negative rail 108 which acts as a reference ground and its cathode coupled to the node 208, a capacitor 418 coupled between the reference ground (negative rail 108) and the node 212 and a resistor 420 coupled between the reference ground (negative rail 108) and the node 214. In this implementation, the inductor 414 and capacitor 418 form a low pass filter and the diode 416 ensures continuity of current flowing through the cycle of the control signal output from the controller 206A. Effectively, the current control module 210 comprises a buck converter that outputs a particular voltage across nodes 212 and 214 based on the control signal on node 208. The controller 206A receives the voltage on node 214 which is an indication of the current flowing between nodes 212 and 214 as the voltage on node 214 is generated based upon the current flowing through the known resistor 420. In one particular implementation, the inductor 414 may have a value of 1 mH, the diode 416 may be of type 1N4148, the capacitor 418 may have a value of 1 μF and the resistor 420 may have a value of 500Ω. It should be understood that other values for components could be used and other architectures for a current module could be used to generate a particular current from node 212 to node 214.

As shown in FIG. 4C, the opto isolator 216 may comprise an LED 422 coupled between node 212 and node 214 and a phototransistor 424 coupled between node 112 and node 114. In operation, the phototransistor 424 generates a virtual resistance across the nodes 112, 114 proportional to the current flowing through the LED 422 which is the current flowing between nodes 212, 214. In other implementations, other designs for an opto isolator may be used.

The virtual resistance generated by the opto isolator 216 may be designed to operate similar to a 0-10V dimming apparatus and thus allow for the constant current driver 102 with dimming terminals connected to nodes 112, 114 to be controlled by the controller 206A via the current control module 210 and the opto isolator 216. The use of the opto isolator ensures that the power within the control module 110A or any components coupled to the controller 110A (ex. a control interface coupled via connection 115) does not create any ground loops with the power input to the constant current driver 102.

In operation, the control apparatus 110A that is powered by the constant current driver 102 can control the particular current output from the constant current driver 102 through the dimming terminals coupled to nodes 112, 114. This functionality enables considerable added value features to be implemented into the lighting apparatus 100A that a standard constant current driver 102 may not normally enable. Specific implementations will be described in detail. In one sample implementation, the control apparatus 110A may decrease or increase the particular current output by the constant current driver 102 and therefore the light output by the lighting module 104 in response to information received via connection 115. The information may include, but is not limited to, motion sense information, occupancy sense information, measured light level information, ambient light information, measured light color/color temperature information, accelerometer information, geo-positioning information and audio information. In another sample implementation, data via a communication protocol that is not enabled on the constant current driver 102 may be received by the control apparatus 110A and used to control the constant current driver 102. This may allow for infrared remote control of the constant current driver 102, protocols such as DMX, DALI, ZigBee to be implemented and/or interoperability with various building management systems. In another sample implementation, the control apparatus 110A may interoperate with a dimming apparatus that may not be enabled to interoperate with the constant current driver 102.

Figure 1B:
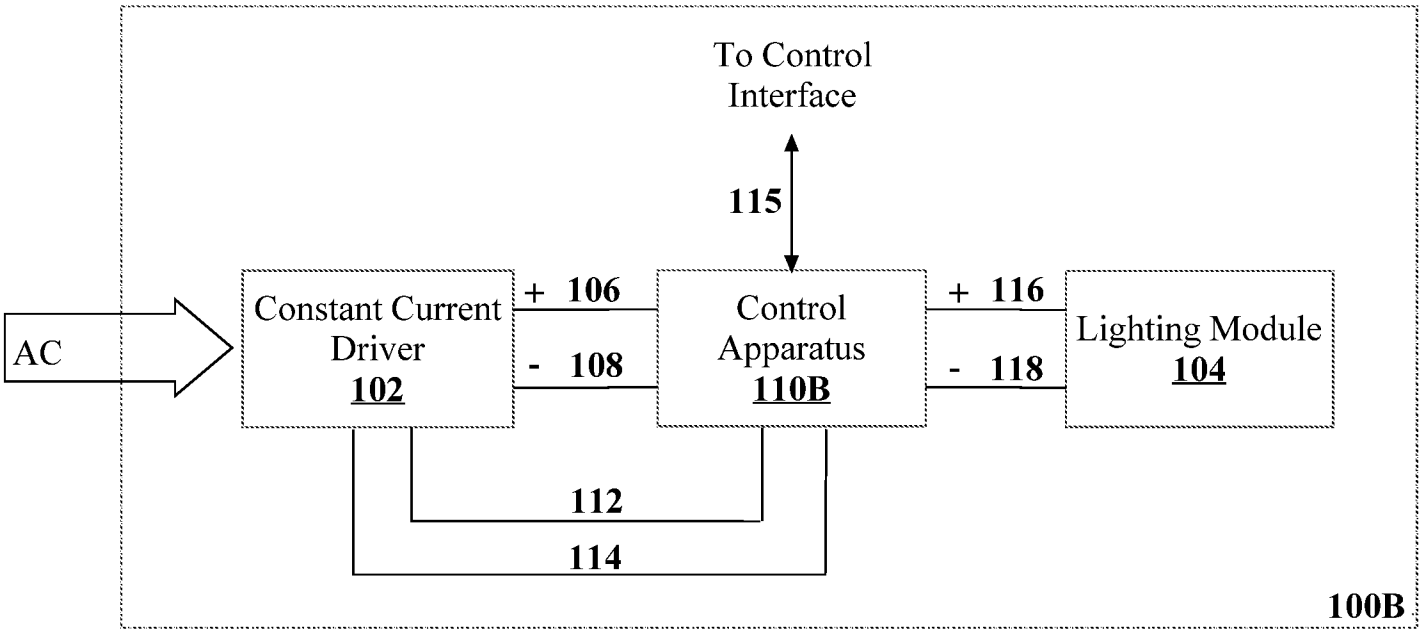

The lighting apparatus 100B of FIG. 1B is similar to lighting apparatus 110A of FIG. 1A but the control apparatus 110A is replaced by control apparatus 110B which is integrated between the constant current driver 102 and the lighting module 104. In this case, positive and negative rails 106, 108 are coupled between the driver 102 and the control apparatus 110B and positive and negative rails 116, 118 are coupled between the control apparatus 110B and the lighting module 104.

Figure 2B:
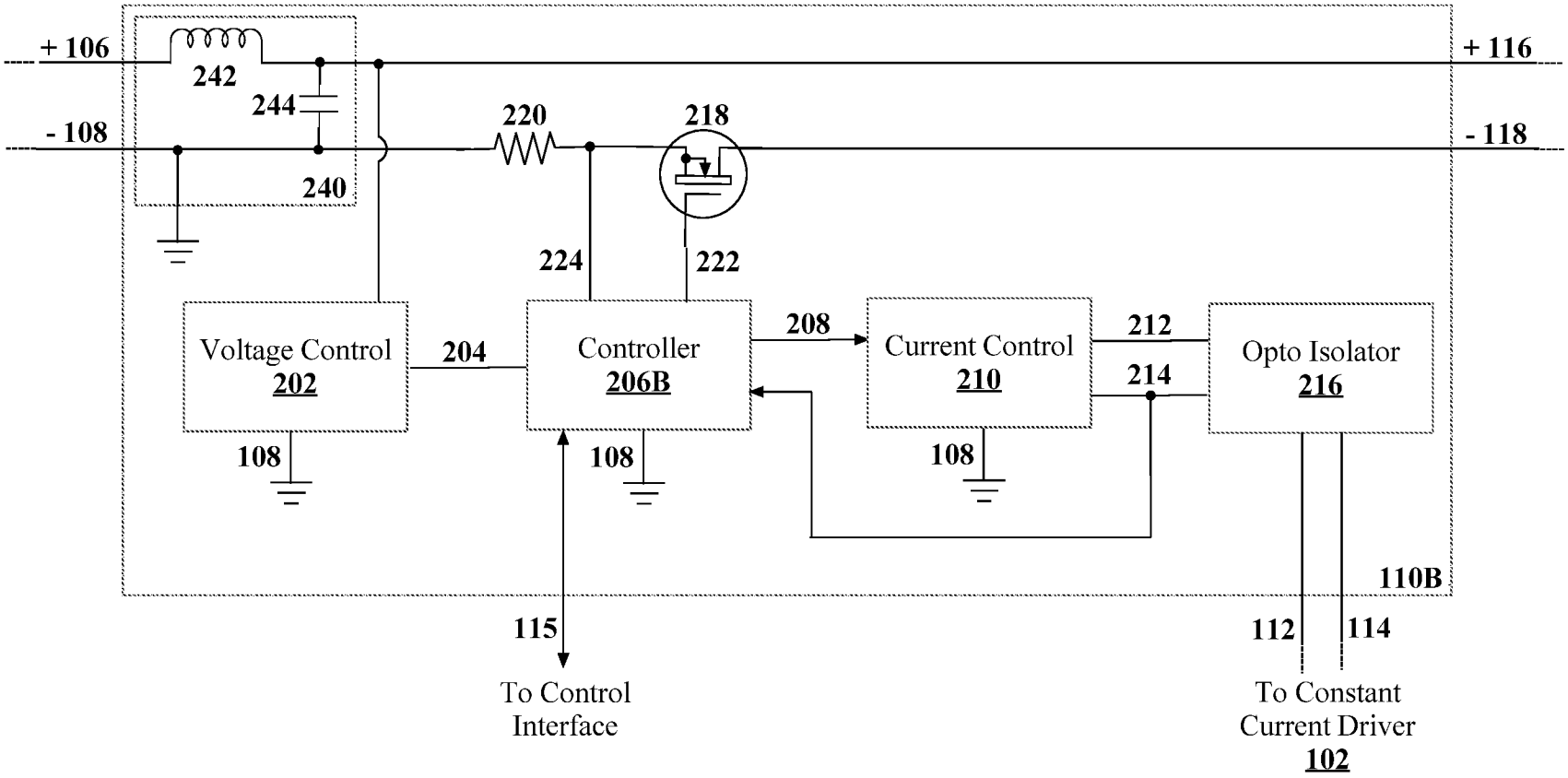

The control apparatus 110B according to one embodiment of the present invention is illustrated in FIG. 2B. As shown, the control apparatus 110B is similar to the control apparatus described with reference to FIG. 2A but the controller 206A is replaced with controller 206B and the control apparatus 110B further comprises a switching element 218 and a resistor 220 coupled in series between the negative rail 118 and the negative rail 108. The controller 206B has an output terminal coupled to a node 222 that controls the switching element 218 and an input terminal coupled to a node 224 coupled between the switching element 218 and the resistor 220. The switching element 218 may comprise an NMOS MOSFET as shown in FIG. 2B or similar component. The resistor 220 may have a value of 0.1Ω, though other values may be used. More sophisticated analog to digital sampling may also be used such as with other current sense resistors that can have lower resistances coupled to high gain amplifiers.

In operation, the controller 206B may activate or deactivate the switching element 218 and therefore enable or disable current from flowing through the lighting module 104. This control over the flow of current to the lighting module 104 may be used for various functions. In one implementation, the control of the switching element 218 may allow the controller 206B to fully turn off the lighting module 104. This is important in some applications as the full turning off a light fixture such that the energy used is below a minimum threshold in an off state is a requirement for Energy Star and other energy conservation standards. Typically the use of dimming terminals to reduce the current output from a constant current driver 102 has a minimum current level (ex. 10% or 1% of total current) and typically a constant current driver 102 does not allow for dimming to zero. To allow for a full off state, a switch may be implemented on the AC side of the constant current driver 102 to turn off the AC power to the constant current driver 102. The use of switching element 218 allows for a full off without implementing a separate AC switch. Upon deactivating the switching element 218, the constant current driver 102 may detect the disconnection of the lighting module 104 and increase the voltage across the positive and negative rails 106, 108 to the maximum voltage limit. In this state, the voltage control module 202 should be adapted to manage the maximum voltage limit and maintain the controlled voltage input to the controller 206B.

In a second implementation, the control of the switching element 218 may allow the controller 206B to disable and then re-enable the current flow through the lighting module 104 for a small amount of time without affecting the constant current driver 102. If disabling and then re-enabling the current flow through the lighting module 104, the controller 206B should utilize a switching frequency sufficiently high to effectively be undetectable to the constant current driver 102. In this case, the constant current driver 102 may detect slightly higher average impedance across the load and increase the voltage across the positive and negative rails 106, 108 slightly to maintain the same average current flowing through the load due to the constant current driver 102. If the time period in which the switching element 218 is deactivated is too long and the constant current driver 102 detects the disconnection of the lighting module 104, the constant current driver 102 will significantly react to the removal of the lighting module 104. In some cases, the constant current driver 102 may adjust the voltage across the positive and negative rails 106, 108 to the maximum voltage limit as the impedance detected across the load will be significantly high and incapable to draw the particular current for the driver 102. In other cases, a safety mode may be enabled. Either of these situations will dramatically affect the visible light output by the lighting apparatus 100B. In some embodiments, once the switching element 218 is turned off for a period of time sufficient to be detected by the constant current driver 102, the switching element 218 should not be turned back on until the constant current driver 102 has adjusted for the removal of the load. In this case, deactivating and then activating the lighting module 104 may be used by the control apparatus 110B to provide acknowledgement to a command received, the command potentially being received via the connection 115. This case allows a person to directly observe a signal from the light as the signal has a duration sufficient to be seen by the human eye. In one embodiment, the controller 206B may be coupled to an infrared sensor via the connection 115 and the command may be in the form of a programming command from an infrared transmitter. Other uses for temporarily deactivating the lighting module 104 causing visible or non-visible affects may occur to one skilled in the art.

It should be noted that forcing the constant current driver 102 to consistently react to the disconnection and then reconnection of the load over and over again could cause strain on the constant current driver 102 and reduce the life of the constant current driver 102. It is not recommended to use the switching element 218 to perform significant PWM dimming of the lighting module 104. This could result in flicker due to the constant current driver 102 reacting quickly to the changes in the load and may result in strain or damage to the constant current driver 102. In addition, an LED light engine may suffer decreased longevity from being subject to a higher instantaneous voltage than that for which it is rated even though the average current is in fact within its rated requirement. In various embodiments of the present invention, dimming of the lighting module 104 is conducted as previously described through the controlling of the dimming terminals of the driver 102 coupled to nodes 112, 114.

In some embodiments, the controller 206B may detect a voltage at node 224, which is an indication of the current flowing through the resistor 220 and therefore the current flowing through the lighting module 104. This indication may be used for various purposes in various implementations. In one case, the detection of the current flowing through the lighting module 104 may be used to ensure a desired current level is being output by the constant current driver 102 and potentially be used as a control variable in feedback to the constant current driver 102 through the control of the dimming terminals through nodes 112, 114. In other implementations in which the controller 206B does not require an indication of the current flowing through the lighting module 104, the resistor 220 may not be implemented and/or the controller 206B may not have an input terminal coupled to node 224.

As depicted in FIG. 2B, the control apparatus 110B may also comprise an optional input filter circuit 240. The input filter circuit 240 may be beneficial depending upon the design of the constant current driver 102. In some cases, the constant current driver 102 may not include an output filter and therefore adjustments in the load coupled to the constant current driver 102 may result in unexpected outcomes. Adding an input filter circuit 240 may be able to mitigate this issue. In the example implementation of FIG. 4B, the filter circuit 240 comprises an inductor 242 coupled between the positive rail 106 and the positive rail 116 and a capacitor 244 coupled between the positive rail 116 and negative rail 108. The input filter 240 could also be implemented within the control apparatus 110A.

Figure 1C:
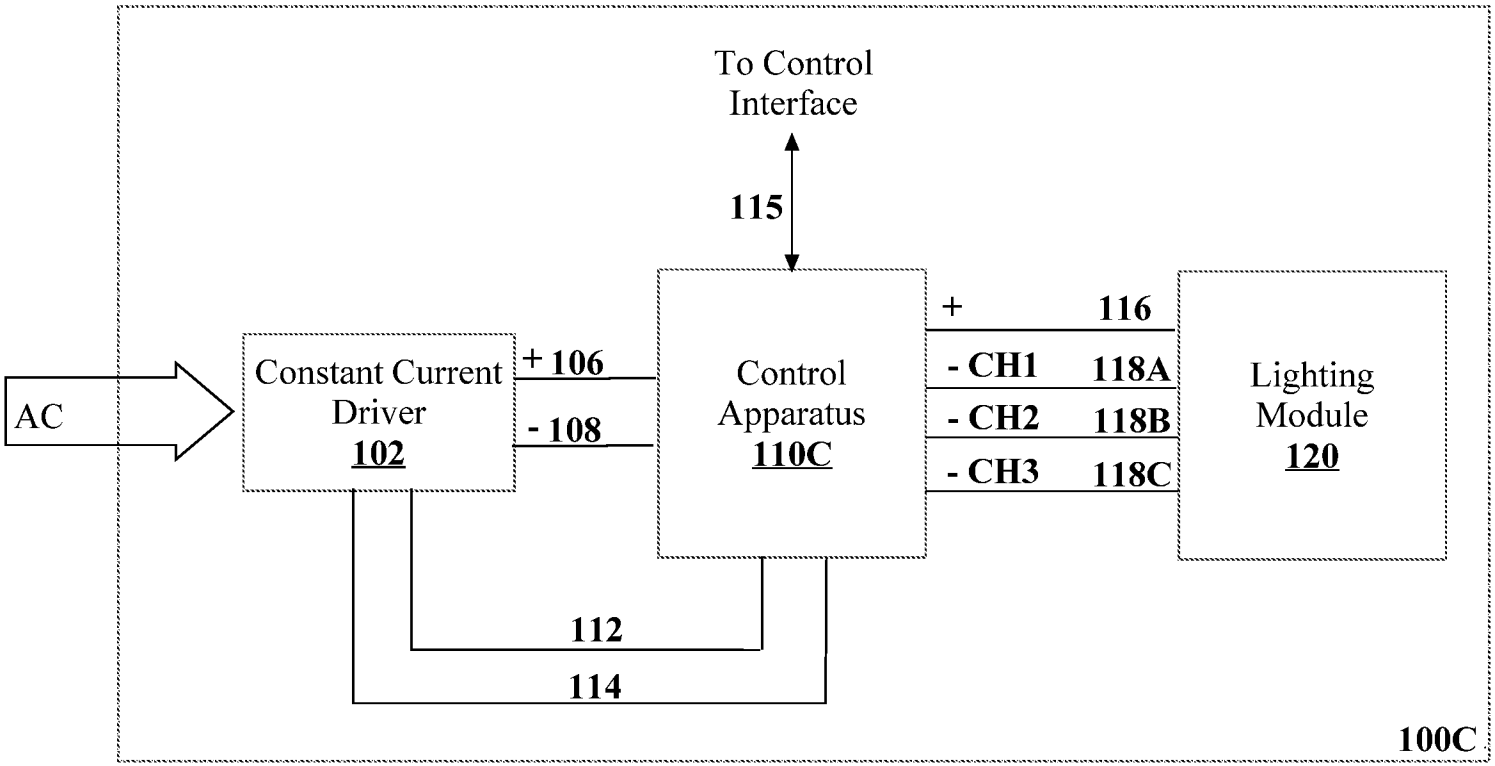

The lighting apparatus 100C of FIG. 1C is similar to lighting apparatus 110B of FIG. 1B but the lighting module 104 is replaced with a lighting module 120 with a plurality of sets of LEDs that can be controlled separately and the control apparatus 110B is replaced with control apparatus 110C which has the negative rail 118 replaced by a plurality of negative rails 118A, 118B, 118C for a plurality channels CH1, CH2, CH3. In this case, the positive rail 116 and the negative rail 118A is used for powering and control of a first set of the LEDs within the lighting module 120, the positive rail 116 and the negative rail 118B is used for powering and control of a second set of the LEDs within the lighting module 120 and the positive rail 116 and the negative rail 118B is used for powering and control of a third set of the LEDs within the lighting module 120. The separate sets of LEDs within the lighting module 120 may each be controlled by one of the channels CH1, CH2, CH3 output from the control apparatus 110C. In one implementation, the sets of LEDs within the lighting module 120 may comprise LEDs of different colors or white LEDs of different color temperatures. By controlling the different channels output from the control apparatus 110C and having the light from the LEDs mix within an optic within the lighting apparatus 100C, various colors and/or color temperatures of light can be output as controlled by the control apparatus 110C. The control apparatus 110C can determine when to activate and deactivate the various sets of LEDs within the lighting module 120 in order to dictate the color and/or color temperature of the light output from the lighting apparatus 100C.

Figure 2C:
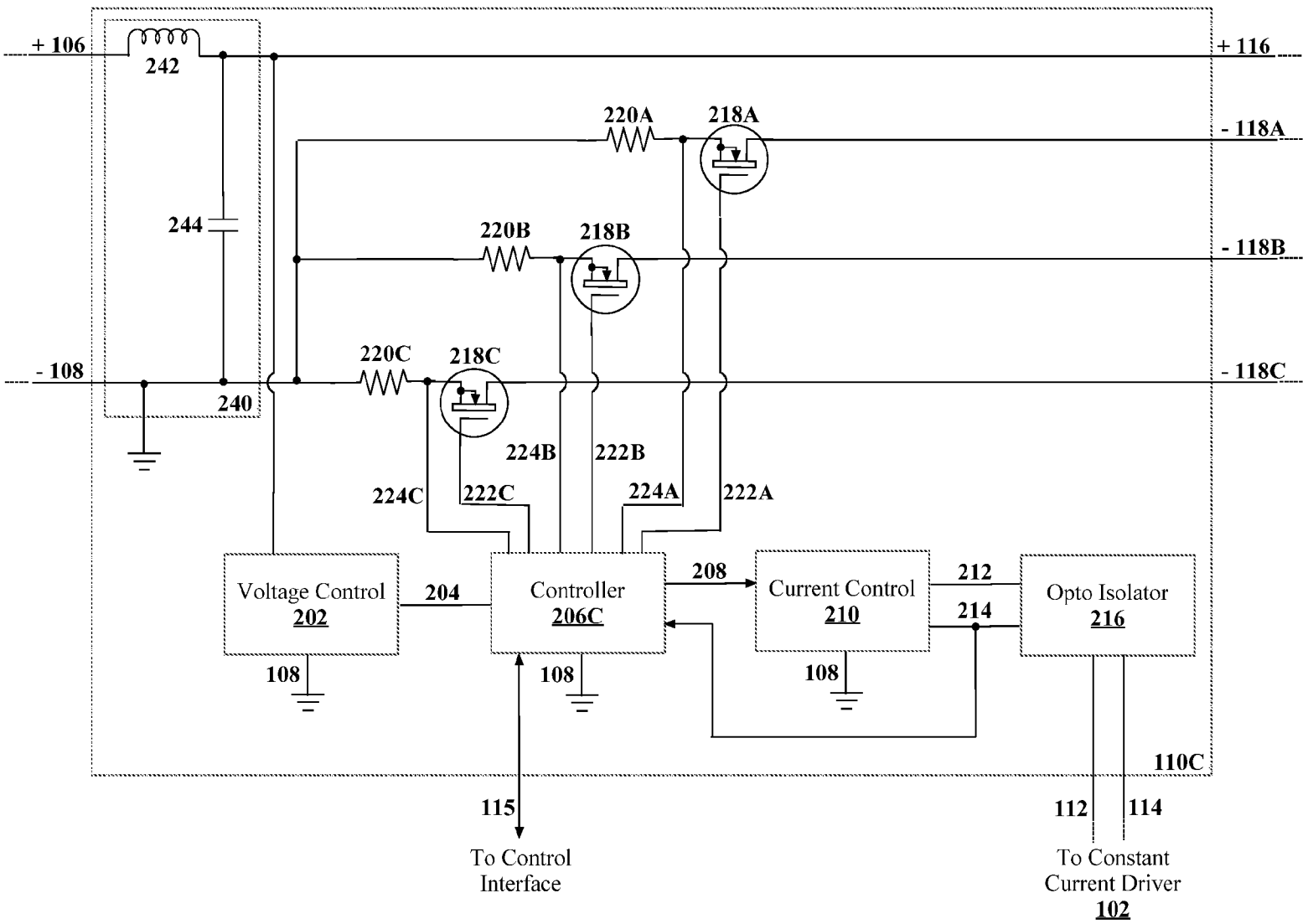

FIG. 2C illustrates the control apparatus 110C according to one embodiment of the present invention. Control apparatus 110C is similar to control apparatus 110B but with controller 206B replaced by controller 206C and the control apparatus 110C comprises three transistors 218A, 218B, 218C instead of one transistor 218 and three resistors 220A, 220B, 220C instead of one resistor 220. As shown, resistor 220A and transistor 218A are coupled in series between the negative rail 108 and the negative rail 118A; resistor 220B and transistor 218B are coupled in series between the negative rail 108 and the negative rail 118B; and resistor 220C and transistor 218C are coupled in series between the negative rail 108 and the negative rail 118C. The controller 206C can independently control the activation and deactivation of the transistors 218A, 218B, 218C with respective control signals 222A, 222B, 222C. In some embodiments, the controller 206C may detect voltages at nodes 224A, 224B, 224C, which are indications of the current flowing through the respective resistors 220A, 220B, 220C and therefore the current flowing through the portion of the lighting module 120 coupled to the respective negative rails 118A, 118B, 118C.

In operation, the controller 206C may coordinate the activation and deactivation of the transistors 218A, 218B, 218C to cause a particularly desired light output from the lighting module 120. In one scenario, each of the portions of the lighting module 120 may comprise LEDs of a different color or color temperature. Mixing of these LEDs in various ratios of intensity can allow for the light output from the lighting module 120 to appear different colors or color temperatures of white. Although depicted for the case in which there are three transistors controlling three portions of the lighting module 120, it should be understood in other implementations there may be two, three, four or more transistors controlling various portions of the lighting module 120. In one example, two transistors may be used to control two different color temperatures of LEDs. In other examples, four transistors may be used to control LEDs of red, green, blue and white colors or five transistors may be used to control LEDs of red, green, blue, a warm white color and a cool white color.

In the case that the controller 206C activates only one of the transistors 218A, 218B, 218C, the current output by the constant current driver 102 will power the one portion of the lighting module 120 connected to the activated transistor. In the case that the controller 206C activates two of the transistors 218A, 218B, 218C, the current output by the constant current driver 102 will be divided between the two portions of the lighting module 120 connected to the activated transistors. If the two portions have a similar forward voltage, the current could be divided relatively equally. In the case that the controller 206C activates all three of the transistors 218A, 218B, 218C, the current output by the constant current driver 102 will be divided between all three portions of the lighting module 120, potentially relatively evenly depending on the forward voltages of the portions of the lighting module 120.

The amount of activation time within a duty cycle as controlled by the controller 206C for each of the transistors 218A, 218B, 218C will dictate the average light intensity radiated from each of the portions of the lighting module 120. The relative ratio of activation times for the transistors 218A, 218B, 218C effectively dictates which portions of the lighting module 120 illuminate brighter and therefore aspects of the mixed light output, such as color or color temperature. Deactivating all three transistors 218A, 218B, 218C for a period of time within a limited period of time is not ideal since forcing the constant current driver 102 to consistently react to the disconnection and then reconnection of the entire load over and over again could cause strain on the constant current driver 102 and reduce the life of the constant current driver 102.

Figure 1D:
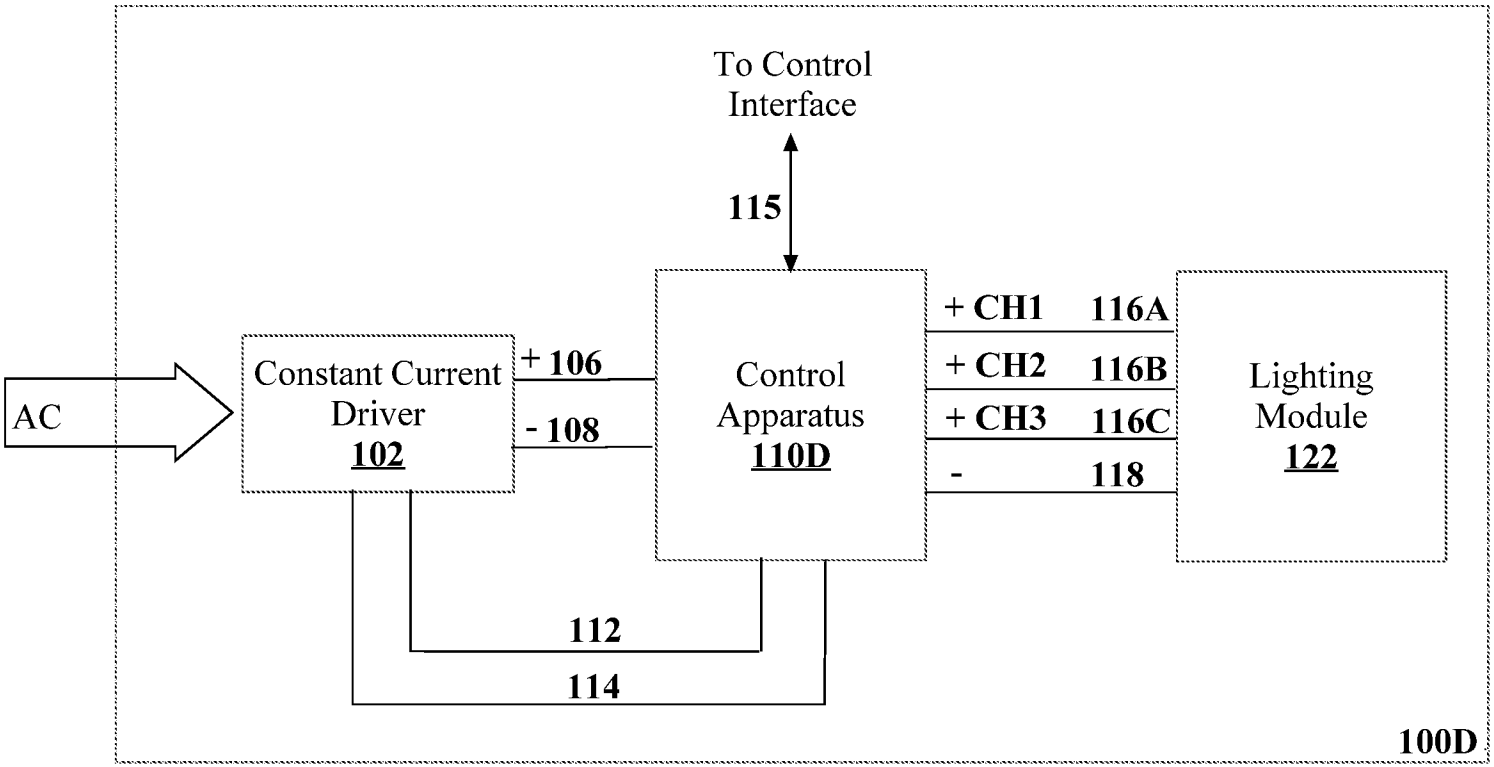

The lighting apparatus 100D of FIG. 1D is similar to lighting apparatus 110C of FIG. 1C but the control apparatus 110C is replaced by the control apparatus 110D which has the positive rail 116 replaced by a plurality of positive rails 116A, 116B, 116C for a plurality channels CH1, CH2, CH3 and the plurality of negative rails 118A, 118B, 118C are replaced by a single negative rail 118. In this case, the control of each portion of a lighting module 122 is being conducted by controlling the positive rails 116A, 116B, 116C rather than the negative rails 118A, 118B, 118C.

Figure 2D:
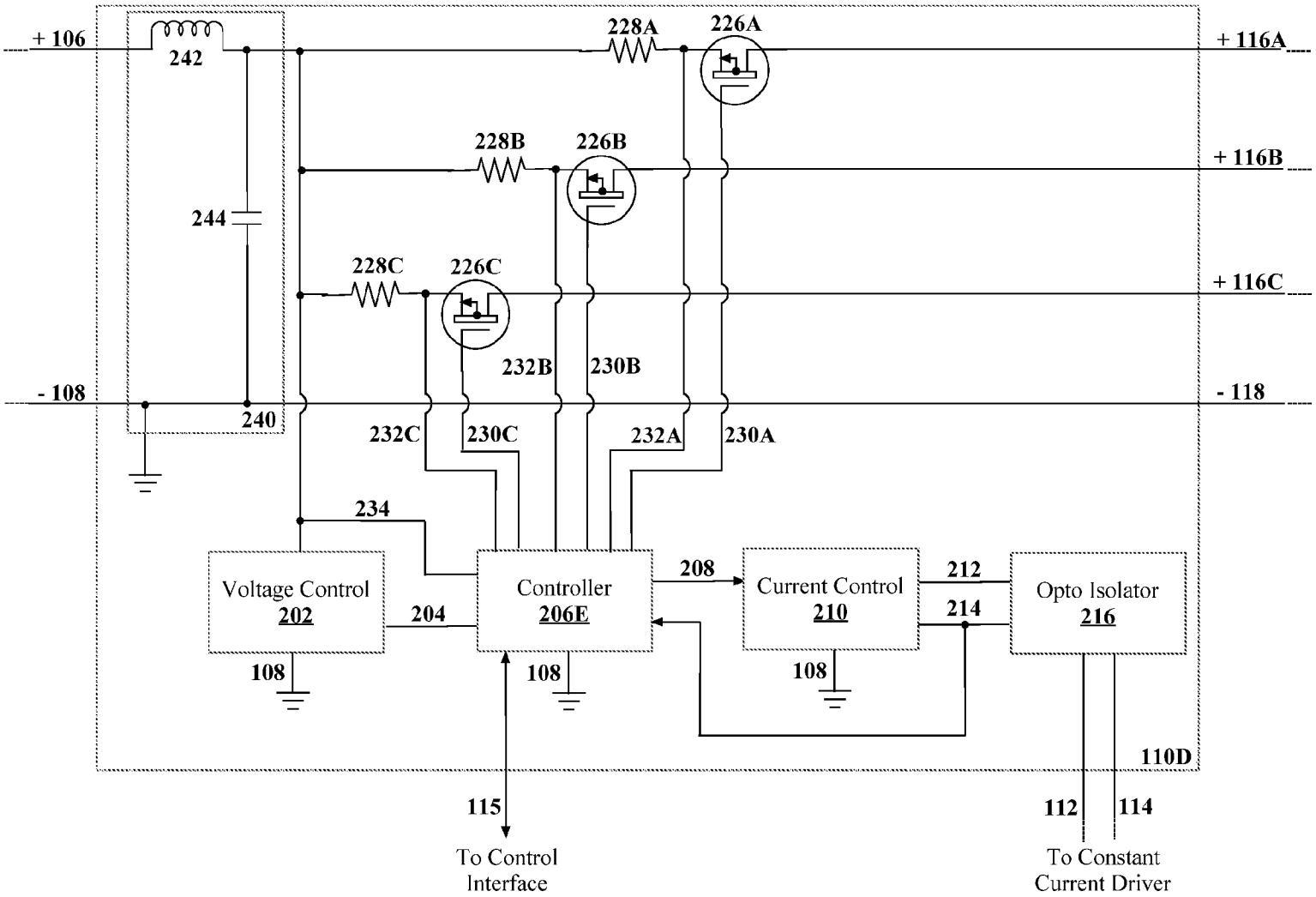

FIG. 2D illustrates the control apparatus 110D according to one embodiment of the present invention. Control apparatus 110D is similar to control apparatus 110C but with controller 206C replaced by controller 206D and the control apparatus 110D comprises three pmos transistors 226A, 226B, 226C instead of the plurality of nmos transistors 218A, 218B, 218C and three resistors 228A, 228B, 228C instead of the three resistors 220A, 220B, 220C. As shown, resistor 228A and transistor 226A are coupled in series between the positive rail 106 and the positive rail 116A; resistor 228B and transistor 236B are coupled in series between the positive rail 106 and the positive rail 116B; and resistor 228C and transistor 226C are coupled in series between the positive rail 106 and the positive rail 116C. The controller 206D can independently control the activation and deactivation of the transistors 226A, 226B, 226C with respective control signals 230A, 230B, 230C. In some embodiments, the controller 206D may detect voltages at nodes 232A, 232B, 232C, which are indications of the current flowing through the respective resistors 228A, 228B, 228C and therefore the current flowing through the portion of the lighting module 120 coupled to the respective positive rails 116A, 116B, 116C. Effectively, the embodiment depicted in FIGS. 1D and 2D is similar in function to the embodiment depicted in FIGS. 1C and 2C. The difference is that the control by the controller 106D is being done using the positive rails rather than the negative rails.

Figure 1E:
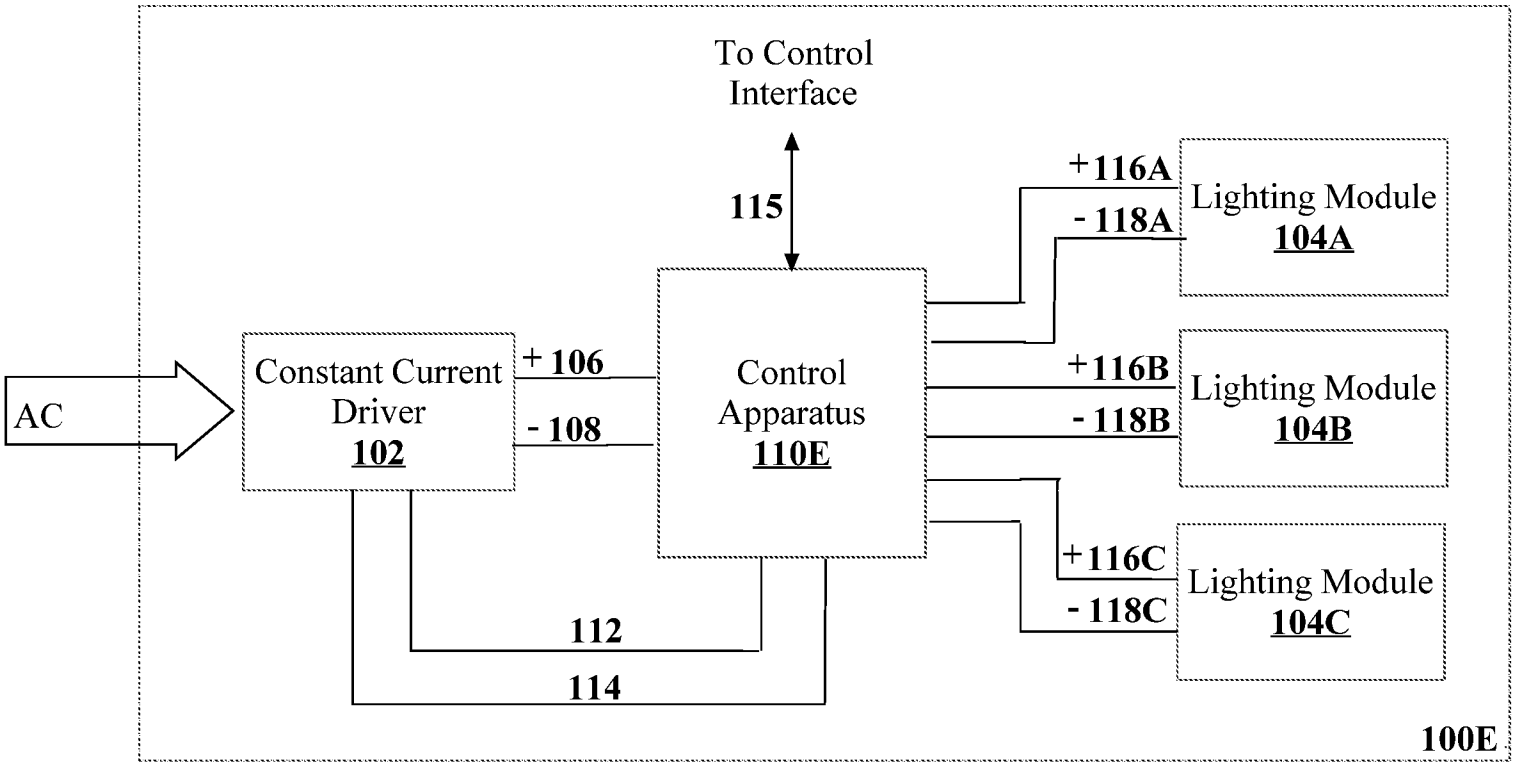

The lighting apparatus 100E of FIG. 1E is similar to lighting apparatuses 110C and 110D of FIGS. 1C, 1D but the control apparatus 110C/110D is replaced by the control apparatus 110E which has outputs of both a plurality of positive rails 116A, 116B, 116C and a plurality of negative rails 116A, 116B, 116C; and the lighting module 120 is replaced by a plurality of lighting modules 104A, 104B, 104C. As depicted, positive rail 116A and negative rail 118A are coupled to the lighting module 104A; positive rail 116B and negative rail 118B are coupled to the lighting module 104B; and positive rail 116C and negative rail 118C are coupled to the lighting module 104C. In one case, the plurality of positive rails 116A, 116B, 116C may be coupled together within the control apparatus 110E and therefore lighting apparatus 100E would be similar to lighting apparatus 100C and control the lighting modules 104A, 104B, 104C similar to controlling the three portions of the lighting module 120. In another case, the plurality of negative rails 118A, 118B, 118C may be coupled together within the control apparatus 110E and therefore lighting apparatus 100E would be similar to lighting apparatus 100D and control the lighting modules 104A, 104B, 104C similar to controlling the three portions of the lighting module 120. In yet another case, the control apparatus 110E may independently control both the positive rail and negative rail connected to each of the lighting modules 104A, 104B, 104C.

Figure 6A:
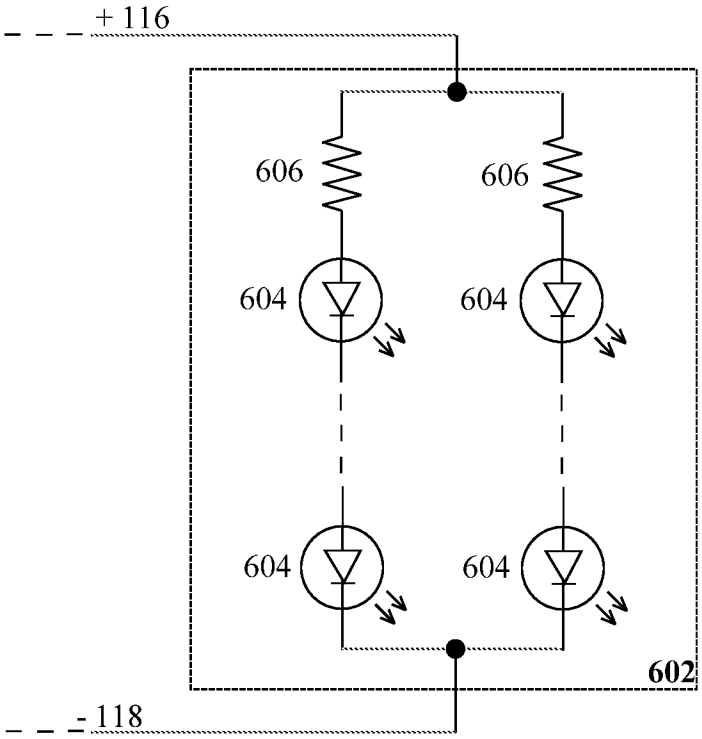
FIGS. 6A, 6B and 6C are block diagrams of lighting modules according to sample embodiments of the present invention.
Figure 6B:
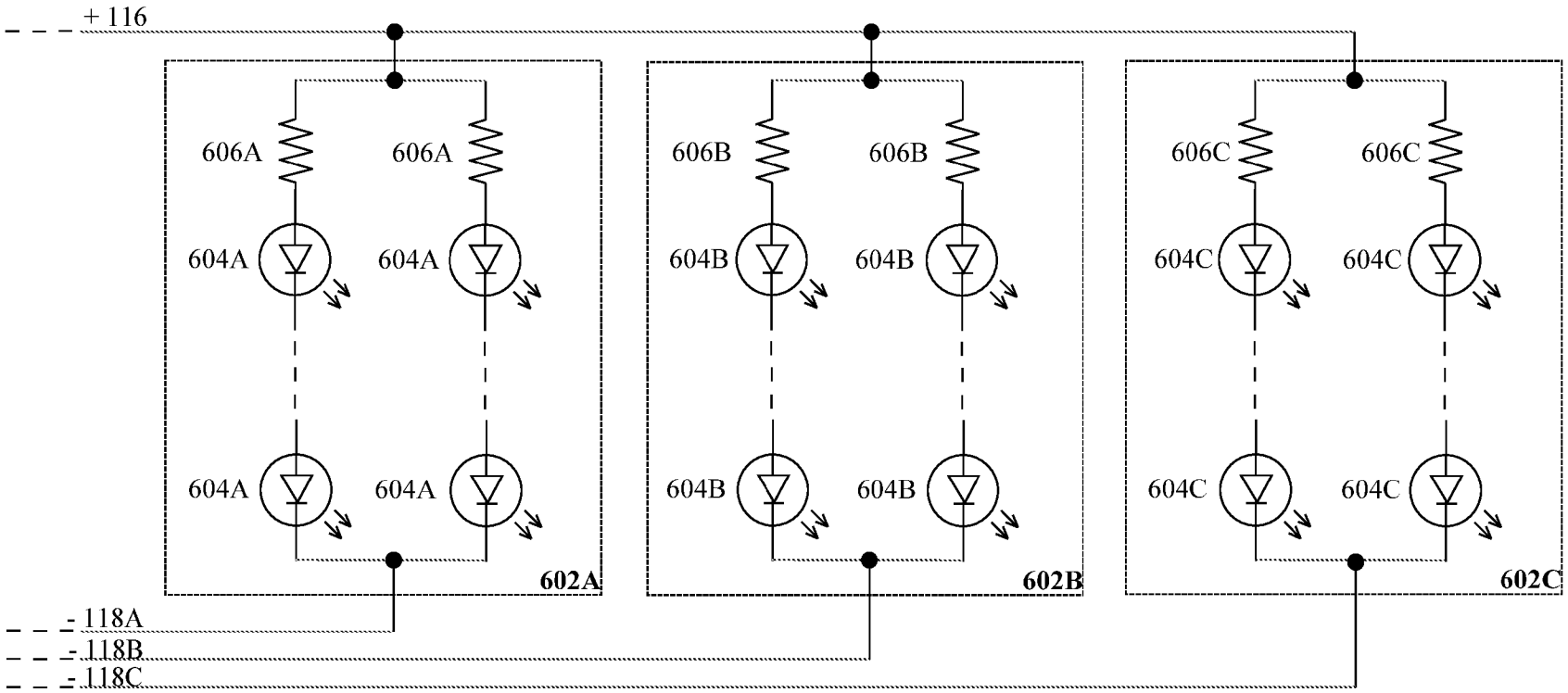
Figure 6C:
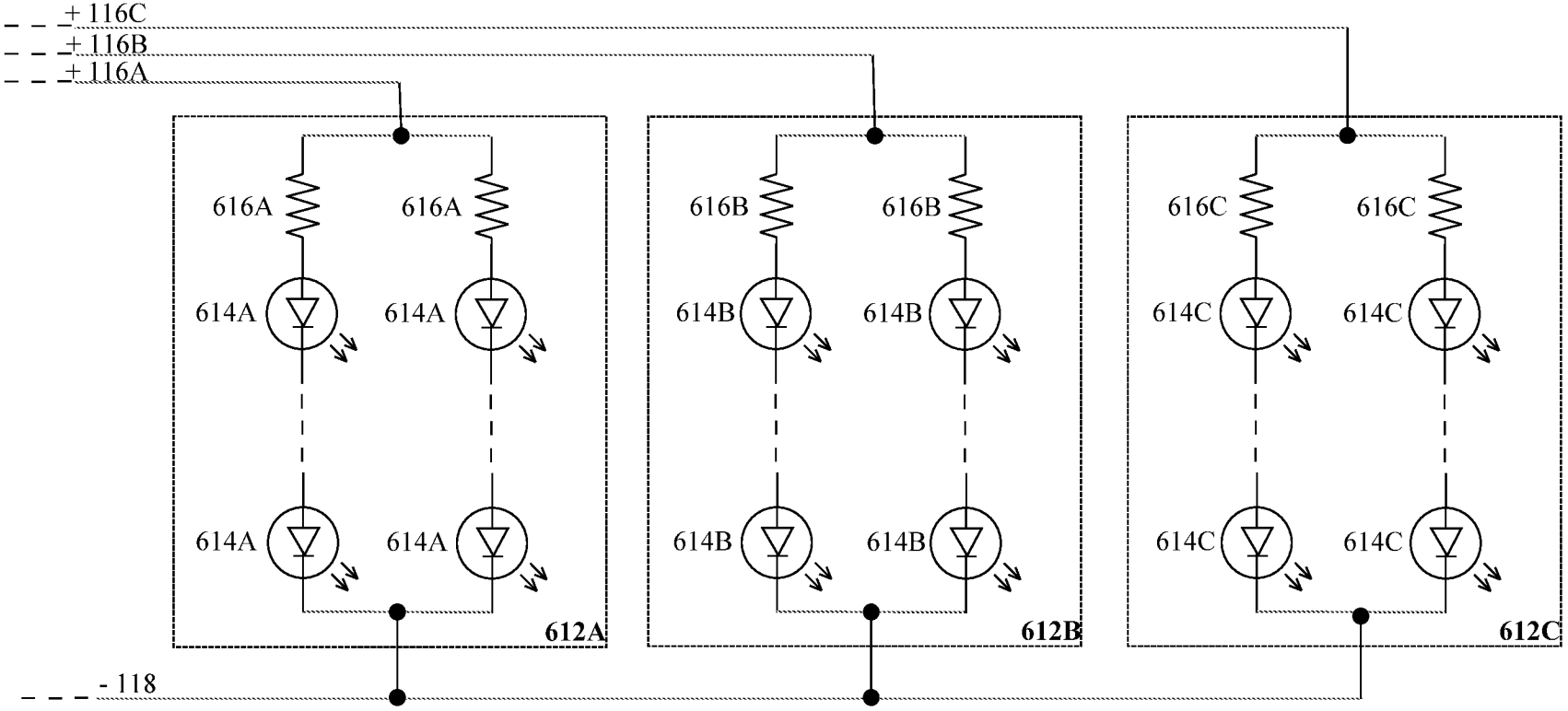

FIGS. 6A, 6B and 6C are block diagrams of lighting modules according to sample embodiments of the present invention. FIG. 6A depicts a sample implementation of lighting module 104 in which a single LED group 602 is coupled between the positive rail 116 and the negative rail 118. In this case, the LED group 602 comprises a plurality of sets of LEDs coupled in parallel, each set of LEDs comprising a plurality of LEDs 604 and a resistor 606 coupled in series. Although shown with two sets of LEDs within the LED group 602, it should be understood that only a single set of LEDs could be implemented or more than two sets of LEDs may be coupled in parallel within the LED group 602. Further, in some implementations, no resistors may be included in series with the LEDs. In one specific implementation, each set of LEDs may comprise seven LEDs and the forward voltage across the LED group 602 may be between 21-24V, depending upon the forward voltage of the LEDs, the current flowing through the LEDs 604 and the thermal temperature.

The lighting modules 104A, 104B, 104C of FIG. 1E may each be implemented similar to the lighting module depicted in FIG. 6A. In that case, each of the lighting modules 104A, 104B, 104C may be implemented with the same or different numbers of sets of LEDs; or the same or different color LEDs or LEDs with the same or different color temperatures of white LEDs. In the lighting apparatus of FIG. 1E, it is preferred that the forward voltages of the lighting modules 104A, 104B, 104C be relatively similar so that the constant current driver 102 is not required to dramatically adjust for the load when switching between the lighting modules 104A, 104B, 104C. Therefore, in some implementations, there may be the same number of LEDs in series within each set of LEDs in each of the lighting modules 104A, 104B, 104C. In cases where one type of LED has a significantly different forward voltage per LED (ex. red LEDs may have a forward voltage approx. 2V compared to most other LEDs having a forward voltage approx. 3V), a different number of LEDs may be in series within each set of LEDs in each of the lighting modules 104A, 104B, 104C to allow for the overall forward voltages to be relatively similar. For example, if blue and green LEDs have approx. 3V forward voltages and red LED have approx. 2V forward voltages, a lighting module 104A comprising red LEDs may comprise a 3:2 ratio of LEDs in series within each set of LEDs relative to lighting modules 104B, 104C comprising green and blue LEDs. In one particular implementation, the lighting module 104A may comprise 12 red LEDs in series in each set of LEDs and the lighting module 104B may comprise 8 green LEDs in series in each set of LEDs and the lighting module 104C may comprise 8 blue LEDs in series in each set of LEDs. In this particular implementation, each of the lighting modules 104A, 104B, 104C would have a forward voltage approximately 24V. It should be understood that other numbers of LEDs may be implemented in series within the lighting modules 104A, 104B, 104C that may result in other forward voltages that are relatively similar. Also, it should be understood that only two lighting modules may be used or more than three lighting modules may be implemented in the lighting apparatus 100E.

FIG. 6B depicts a sample implementation of lighting module 120 of FIG. 1C in which an LED group 602A is coupled between the positive rail 116 and the negative rail 118A; an LED group 602B is coupled between the positive rail 116 and the negative rail 118B; and an LED group 602C is coupled between the positive rail 116 and the negative rail 118C. In this case, the LED group 602A comprises a plurality of sets of LEDs coupled in parallel, each set of LEDs comprising a plurality of LEDs 604A and a resistor 606A coupled in series; the LED group 602B comprises a plurality of sets of LEDs coupled in parallel, each set of LEDs comprising a plurality of LEDs 604B and a resistor 606B coupled in series; and the LED group 602C comprises a plurality of sets of LEDs coupled in parallel, each set of LEDs comprising a plurality of LEDs 604C and a resistor 606C coupled in series. Although shown with two sets of LEDs within each of the LED groups 602A, 602B, 602C, it should be understood that only a single set of LEDs could be implemented or more than two sets of LEDs may be coupled in parallel within each of the LED groups 602A, 602B, 602C. In some embodiments, the LEDs 604A, 604B, 604C of the different LED groups 602A, 602B, 602C may comprise LEDs of different colors or white LEDs of different color temperatures or a combination of LEDs of different color and white LEDs of different color temperatures. Although depicted with three LED groups, it should be understood that the lighting module could comprise only two LED groups or may comprise more than three LED groups. Further, in some implementations, no resistors may be included in series with the LEDs.

FIG. 6C depicts a sample implementation of lighting module 122 of FIG. 1D in which an LED group 612A is coupled between the positive rail 116A and the negative rail 118; an LED group 612B is coupled between the positive rail 116 and the negative rail 118; and an LED group 612C is coupled between the positive rail 116C and the negative rail 118. In this case, the LED group 612A comprises a plurality of sets of LEDs coupled in parallel, each set of LEDs comprising a plurality of LEDs 614A and a resistor 616A coupled in series; the LED group 612B comprises a plurality of sets of LEDs coupled in parallel, each set of LEDs comprising a plurality of LEDs 614B and a resistor 616B coupled in series; and the LED group 612C comprises a plurality of sets of LEDs coupled in parallel, each set of LEDs comprising a plurality of LEDs 614C and a resistor 616C coupled in series. Although shown with two sets of LEDs within each of the LED groups 612A, 612B, 612C, it should be understood that only a single set of LEDs could be implemented or more than two sets of LEDs may be coupled in parallel within each of the LED groups 612A, 612B, 612C. In some embodiments, the LEDs 614A, 614B, 614C of the different LED groups 612A, 612B, 612C may comprise LEDs of different colors or white LEDs of different color temperatures or a combination of LEDs of different color and white LEDs of different color temperatures. Although depicted with three LED groups, it should be understood that the lighting module could comprise only two LED groups or may comprise more than three LED groups. Further, in some implementations, no resistors may be included in series with the LEDs.

Figure 3A:
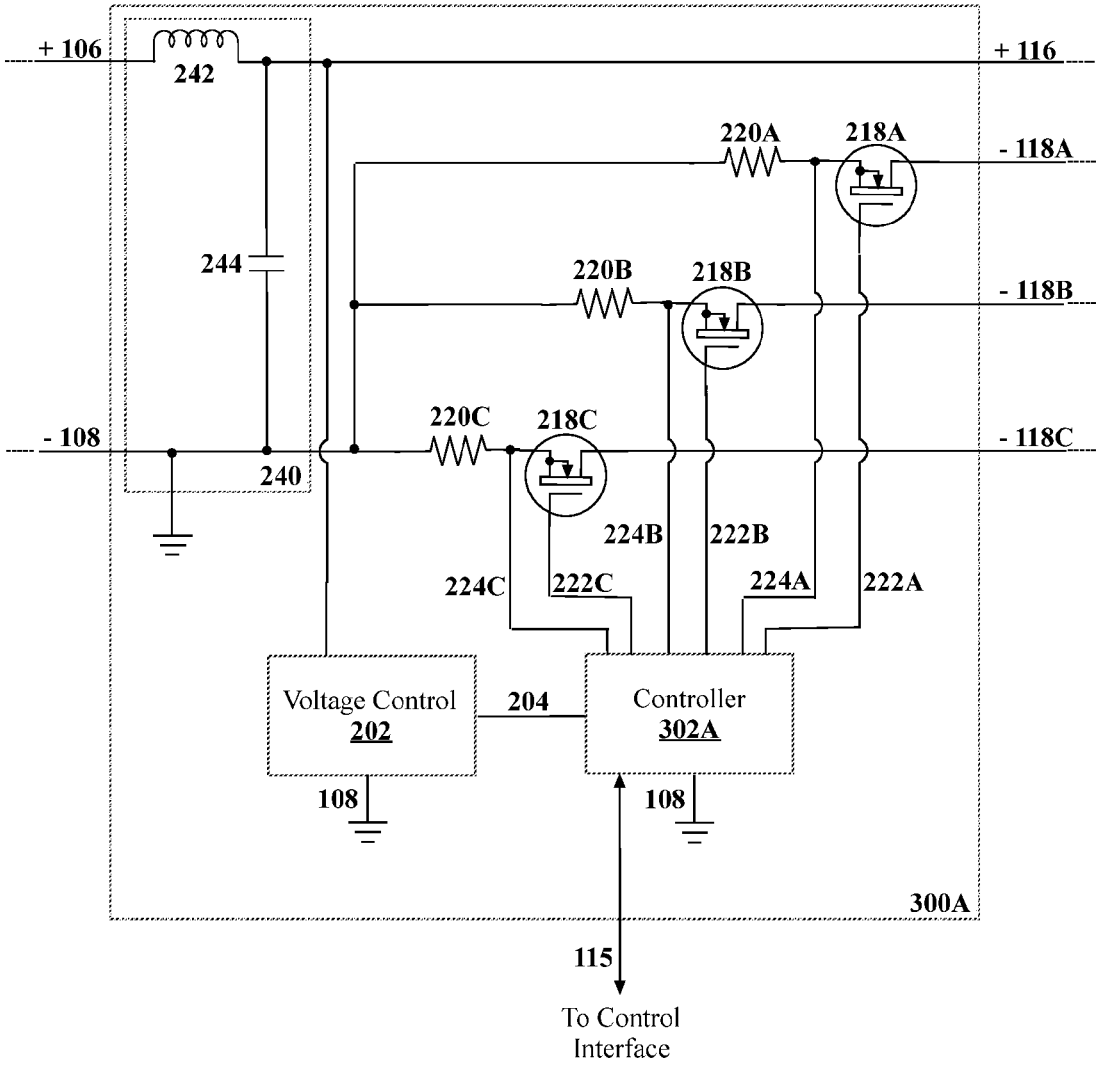
FIGS. 3A and 3B are alternative block diagrams of the control apparatus of FIGS. 1C and 1D respectively with no feedback to the constant current driver.
Figure 3B:
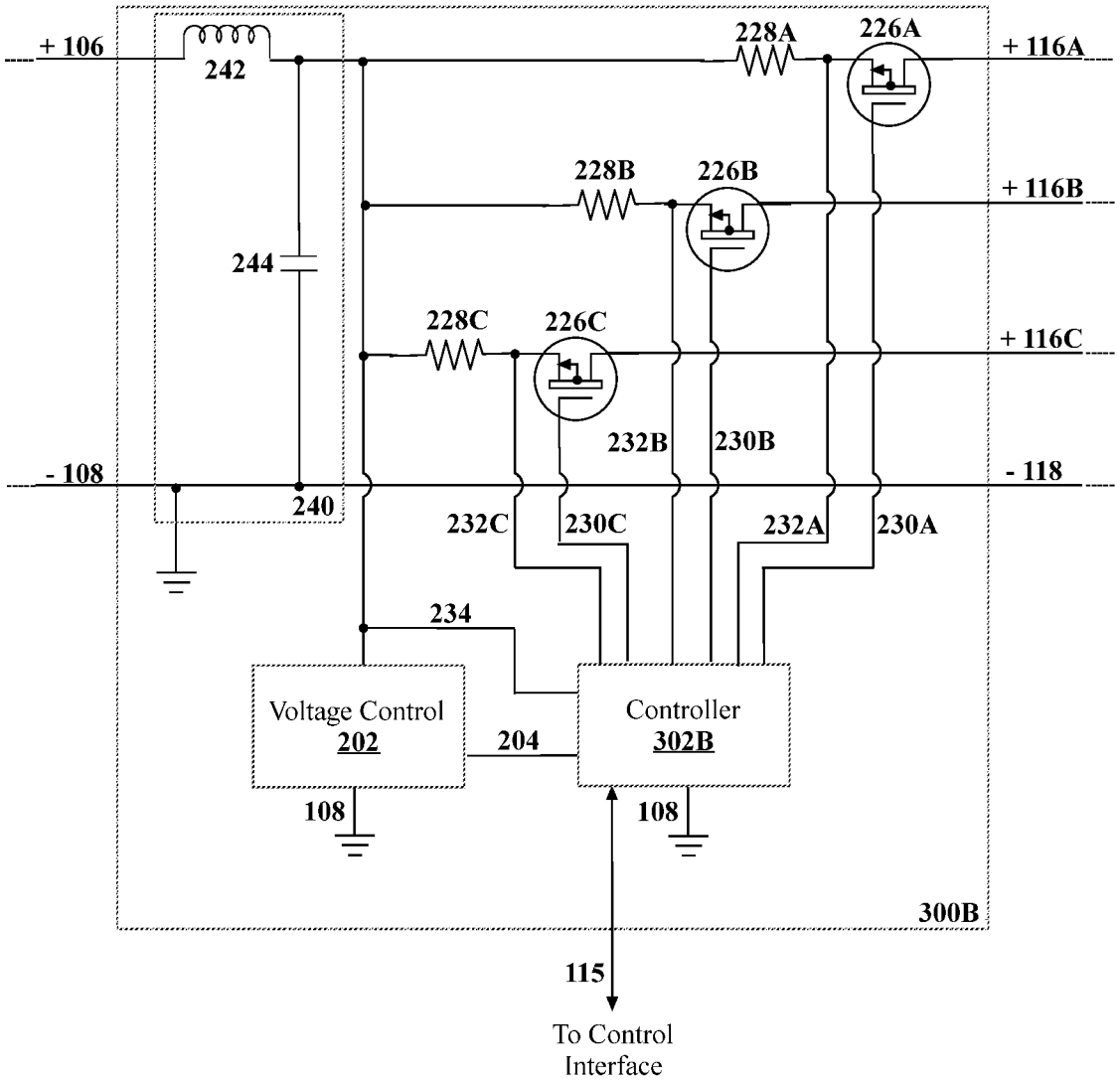

FIGS. 3A and 3B are alternative block diagrams of the control apparatus of FIGS. 1C and 1D respectively with no feedback to the constant current driver. In these cases, the control apparatus is powered from the constant current driver 102 as described but does not require the circuitry to control the dimming of the constant current driver 102. As depicted in FIG. 3A, the control apparatus 300A is similar to the control apparatus 110C but the constant control module 210 and the opto isolator 216 have been removed. Similarly, as depicted in FIG. 3B, the control apparatus 300B is similar to the control apparatus 110D but the constant control module 210 and the opto isolator 216 have been removed.

Although described for a single constant current driver implemented within the lighting apparatus of each of the various embodiments of the present invention, it should be understood that a plurality of constant current drivers may be utilized to power a single lighting module or plurality of lighting modules. The control apparatus may be implemented between a plurality of constant current drivers and the lighting module(s). Further, although depicted within the lighting apparatus, the constant current driver and/or the controller may be implemented separate from the lighting apparatus. In these cases, the driver and/or controller may be located local to the remaining portions of the lighting apparatus.

In other embodiments, the control apparatus may be integrated with the lighting module within the lighting apparatus. In particular, elements of the control apparatus 110A, 110B may be integrated with the lighting module 104.

For instance, in some implementations, switching element 218 and/or resistor 220 may be implemented within the lighting module 104. In other embodiments, other elements within the control apparatus 110A, 110B, in whole or in part, may be implemented within the lighting module 104. Similarly, elements of the control apparatus 110C, in whole or in part, may be integrated with the lighting module 120; elements of the control apparatus 110D, in whole or in part, may be integrated with the lighting module 122; and elements of the control apparatus 110E, in whole or in part, may be integrated with one or more of the lighting modules 104A, 104B, 104C.

Figure 5A:
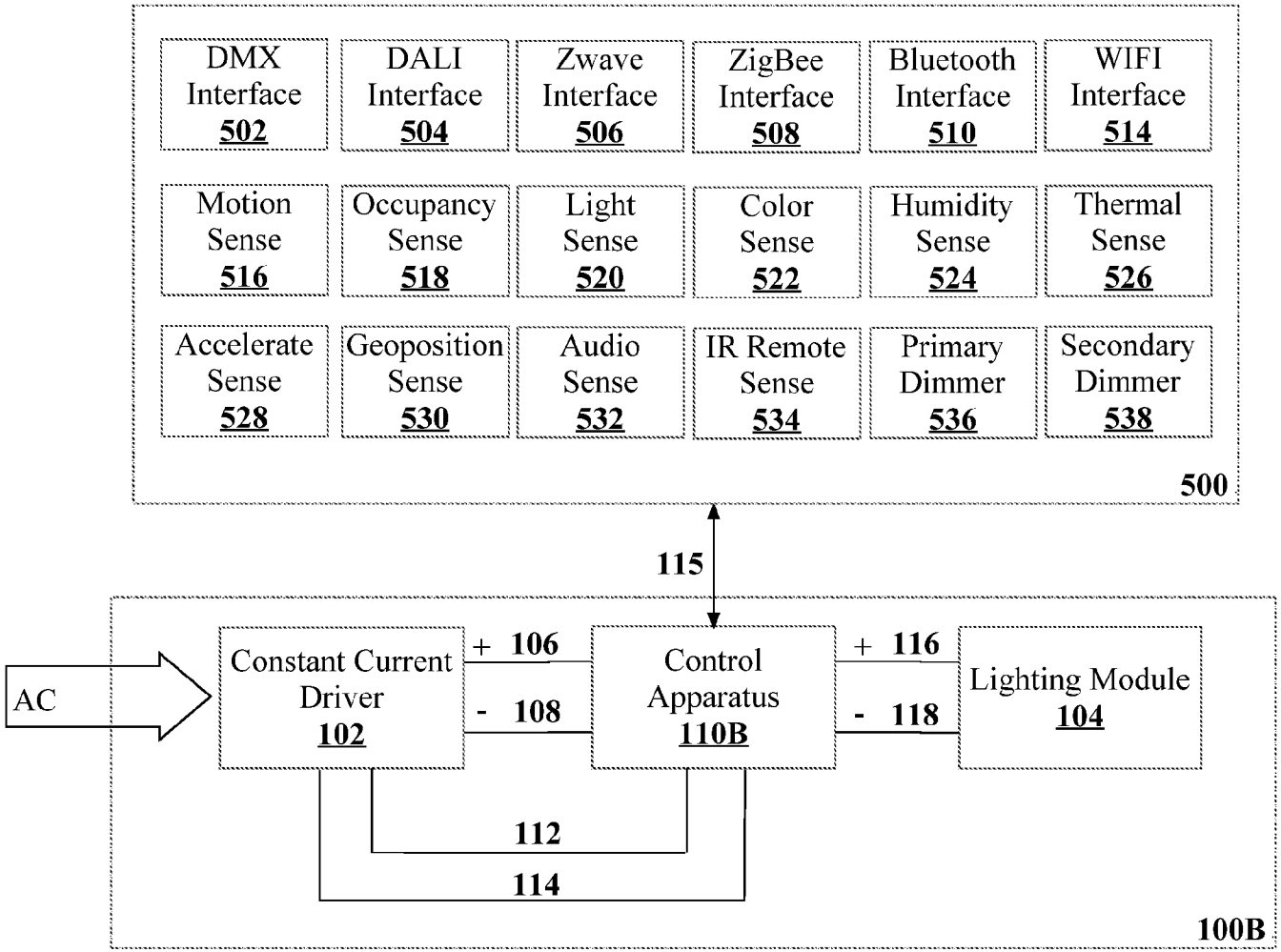
FIG. 5A is a block diagram of an embodiment of the lighting apparatus of FIG. 1B illustrating a plurality of accessory control components.

FIG. 5A is a block diagram of an embodiment of the lighting apparatus of FIG. 1B illustrating a plurality of accessory control components. The decisions made by the controller within each of the various embodiments of the present invention may be controlled at least in part by one or more of these accessory control components that may connect to the controller 110B via connection 115. As illustrated in FIG. 5, the components could include, but are not limited to, a DMX interface 502, a DALI interface 504, a Zwave interface 506, a ZigBee interface 508, a Bluetooth interface 510, a WiFi interface 514, a motion sense module 516, an occupancy sense module 518, a light sense module 520, a color sense module 522, a humidity sense module 524, a thermal sense module 526, an accelerate sense module 528, a geo-position sense module 530, an audio sense module 532, an IR remote sense module 534, a primary dimmer such as a 0-10V dimmer that may indicate desired intensity, a secondary dimmer such as a 0-10V dimmer that may indicate another desired aspect such as color temperature or color. It should be understood that although FIG. 5 depicts the lighting apparatus of FIG. 1B, other embodiments of the present invention could also interface with one or more of the accessory control components shown. Further, although the accessory control components are depicted external to the lighting apparatus 100B, in some embodiments one or more of the accessory control components may be implemented within the lighting apparatus 100B.

Figure 5B:
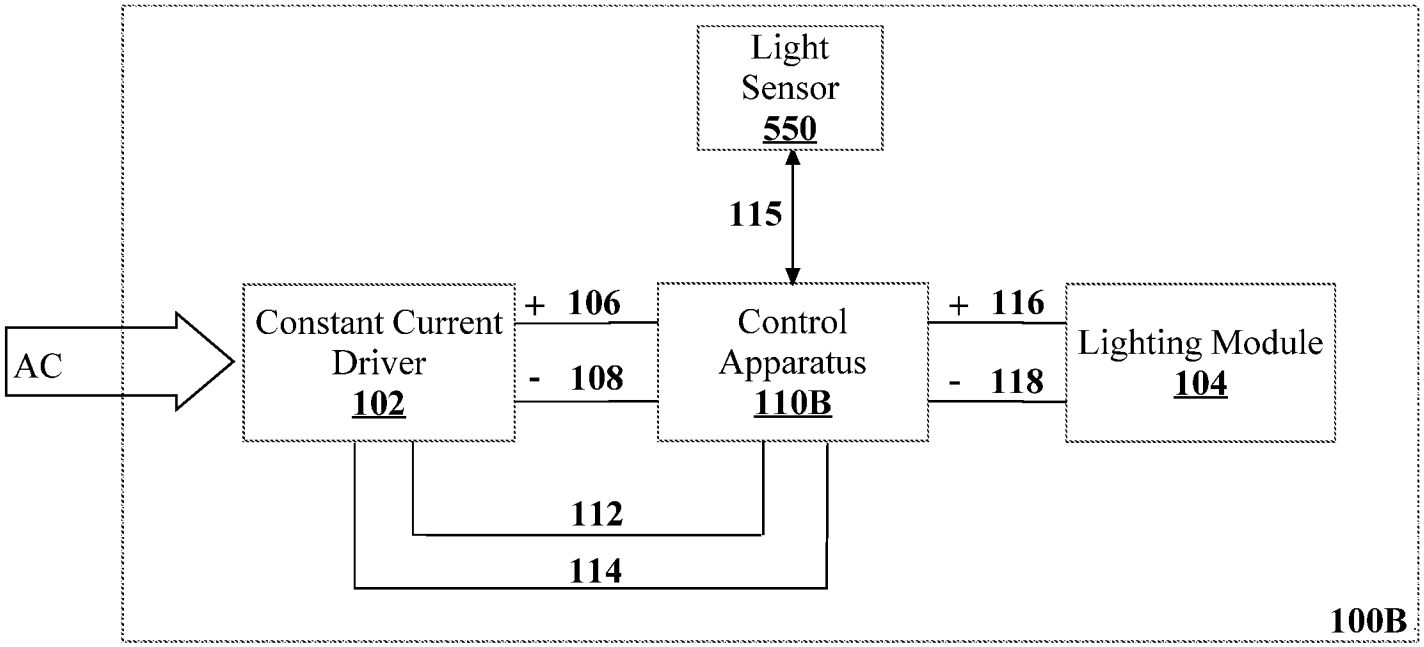
FIG. 5B is a block diagram of an embodiment of the lighting apparatus of FIG. 1B using a light sensor for daylight harvest dimming.

If the deactivating and activating of the switching element 218 is conducted sufficiently quickly to not be detected by the constant current driver 102, a variety of functions may be enabled using the control apparatus 110B (or other versions of the control apparatus that allow for control over a switching element). FIG. 5B is a block diagram of an embodiment of the lighting apparatus of FIG. 1B using a light sensor 550 for daylight harvest dimming. In one embodiment, the controller 206B may be coupled via the connection 115 to the light sensor 550 and the controller 206B may deactivate the switching element 218 for a small period of time (ex. 10 μs) sufficient to take a sample of ambient light levels without interference from the lighting module 104. This small period of time may be sufficiently short so as to not be visible to the human eye and not be detectable by the constant current driver 102. A more detailed description of a similar architecture is described within U.S. Pat. No. 8,941,308 by Briggs entitled "LIGHTING APPARATUS AND METHODS FOR CONTROLLING LIGHTING APPARATUS USING AMBIENT LIGHT LEVELS" issued on Jan. 27, 2015 and incorporated by reference in the present application.

In some embodiments, the controller 206B may control the switching element 218 to deactivate and activate in a particular pattern to communicate information. This could be implemented in a wide range of methods. In one embodiment, when the controller 206B initiates a communication, it may start to modulate the deactivation and activation of the switching element to transmit data. In one particular implementation, the controller 206B may slowly start modulating the switching element 218 so that the switching element 218 transitions from being fully activated to being deactivated for a limited number of time segments. In one implementation, the duty cycle may transition to 93.75% or 240 time segments active for every 256 time segments within a cycle. This transition to a predefined duty cycle should be sufficiently slow so that the constant current driver 102 can adjust to the change in impedance within the load. Effectively, the constant current driver 102 will detect an increase in impedance and, to maintain the particular current flowing through the load, the driver 102 will slowly increase the voltage across the positive and negative rails 106, 108. If done slowly, the changes in the duty cycle will be fully compensated by the changes in the instantaneous current such that the average current applied to the lighting module 104 will remain constant. This transition to a predefined duty cycle could be considered a preamble for communications and may be detected by a receiver that incorporates light detection sensors. The preamble may take a predetermined time period that the controller 206B and the receiver understand. In some embodiments, the preamble can be continued beyond the transition to ensure proper communication and synchronization.

Once the preamble is completed and the controller 206B is modulating the switching element 218 at the desired duty cycle, the controller 206B may use Simple Frequency Shift Key (FSK) modulation to transmit bits of information. In one implementation, a "one" fractional-symbol chip could comprise maintaining the switching element active for 240 of 256 time segments within a cycle and a "zero" fractional-symbol chip could comprise maintaining the switching element active for 210 of 224 time segments. If a time sequence was 0.125 μs for example, the activation period for the "one" fractional-symbol chip would be 30 μs per 32 μs or a duty cycle of 93.75% at a frequency of 31.25 KHz and the activation period for the "zero" fractional-symbol chip could be 26.25 μs per 28 μs or a duty cycle of 93.75% at a frequency of approx. 35.7 KHz. In this case, the two fractional-symbol chips (which could be interchanged) would allow for a constant duty cycle to be used with a different frequency for each of the bits. In a further implementation, when a zero or one bit is to be transmitted, the fractional-symbol chip may be transmitted a plurality of times in a row. This can provide durability and can simplify demodulation. For instance, using the example above, the "one" fractional-symbol chip may be transmitted seven times in a row for a total time segments of 7×256=1792 time segments and the "zero" fractional-symbol chip may be transmitted eight times in a row for a total time segments of 8×224=1792 time segments. In this implementation, the length of the symbol representing a zero bit and the symbol representing a one bit will be identical. This consistency on bit symbol duration decreases the potential of flicker being detected by human observers and can make the demodulation simpler. Further, the repetition of the plurality of chips per symbol increases durability and signal-to-noise ratio of the transmissions.

Once the data has been communicated, the controller 206B may slowly stop modulating the switching element 218 so that the switching element 218 transitions from being deactivated for a limited number of time segments to being back fully activated. Effectively, the constant current driver 102 will detect a decrease in impedance and, to maintain the particular current flowing through the load, the driver 102 will slowly decrease the voltage across the positive and negative rails 106, 108. This transition from a predefined duty cycle to a fully activated state could be considered a postamble for communications and may be detected by a receiver that incorporates light detection sensors. The postamble may take a predetermined time period that the controller 206B and the receiver understand.

Figure 7A:
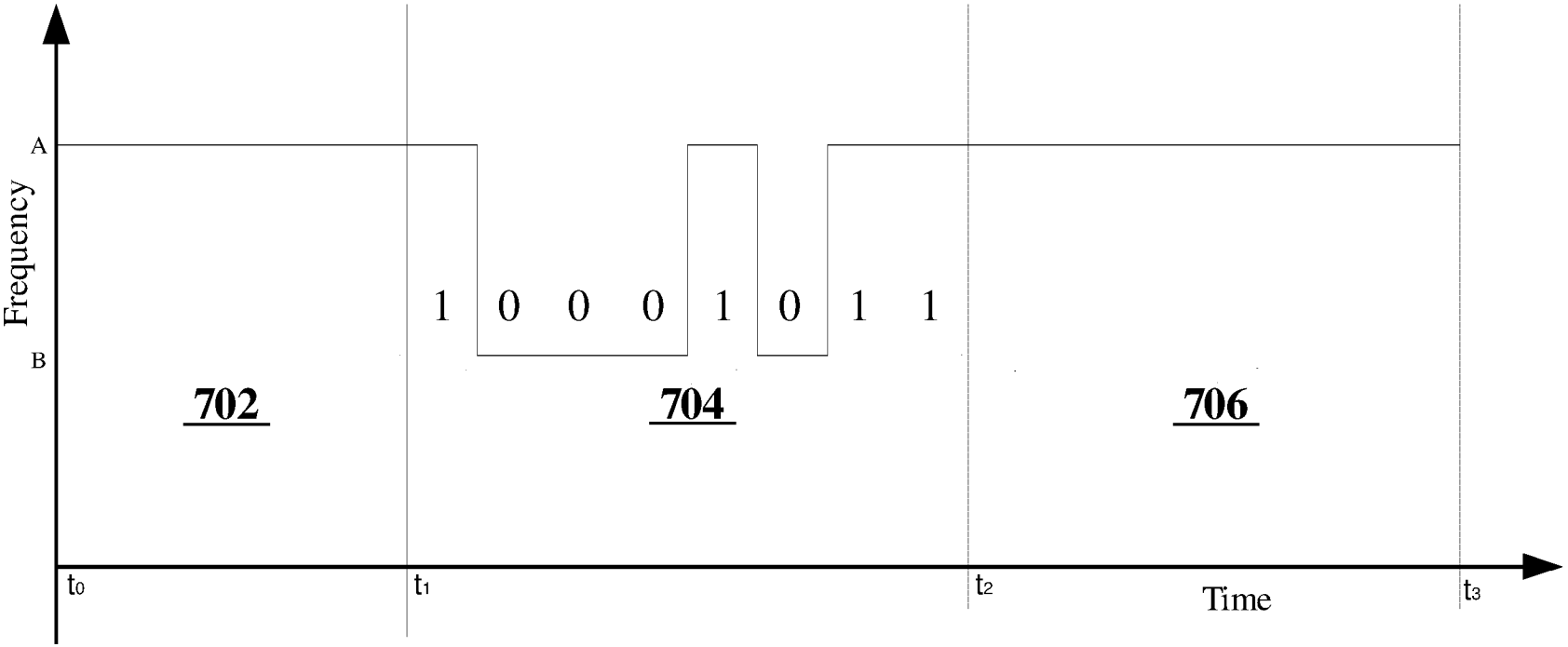
FIGS. 7A and 7B are frequency vs. time diagrams illustrating a sample communication from a lighting apparatus of FIG. 1B including a preamble, data and a postamble.
Figure 7B:
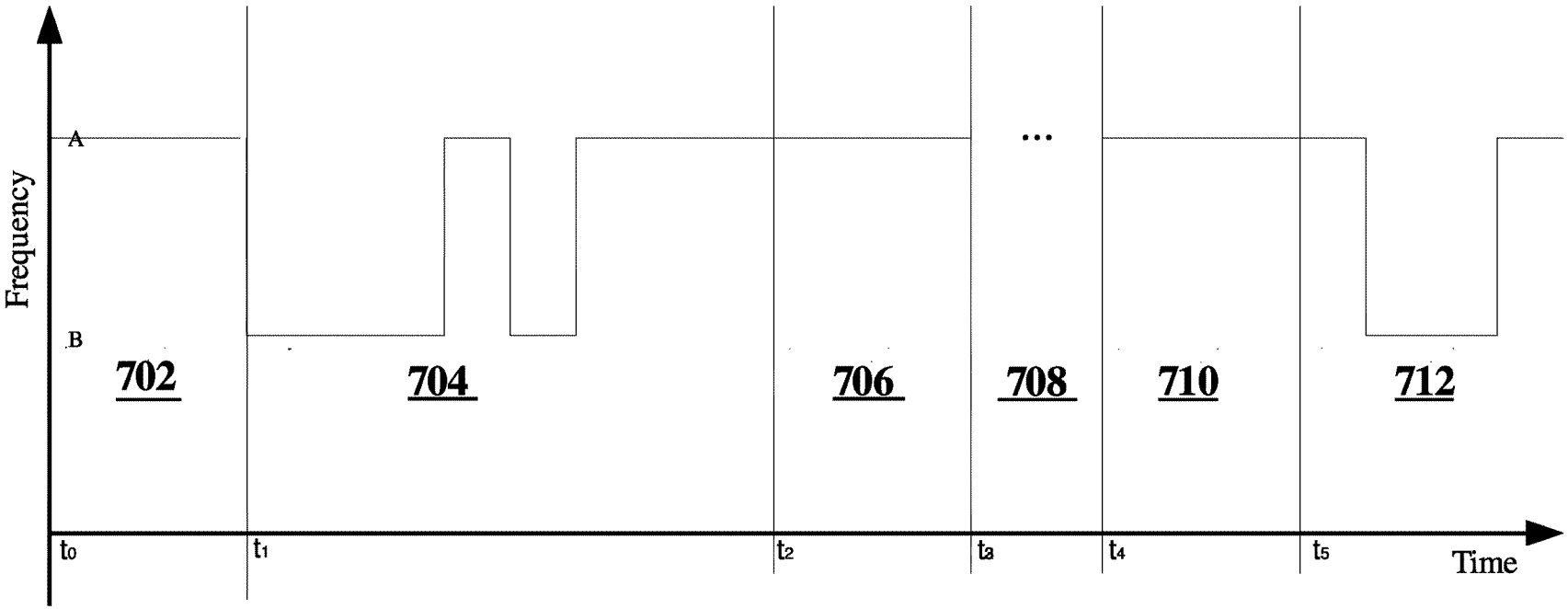

FIGS. 7A and 7B are frequency vs. time diagrams illustrating a sample communication from a lighting apparatus of FIG. 1B including a preamble, data and a postamble. As depicted in FIG. 7A, the controller 206B has set the frequency of the modulation of the switching element 218 to a first frequency A during a preamble stage 702 between time to and $t_1$. During this preamble stage 702, the controller 206B may go from not modulating the switching element 218 to transitioning to modulating at the first frequency A at a duty cycle desired for communication. Subsequently, the controller 206B may transmit data during a data transmission stage 704 (or payload) by adjusting between the first frequency A indicating a first bit, a 1 bit in the case of FIG. 7A, and a second frequency B indicating a second bit, a 0 bit in the case of FIG. 7A. As shown in the example of FIG. 7A, the data comprises the bits 10001011 and may be transmitted between time $t_1$ and $t_2$. After transmission of the data, a postamble stage 706 is completed between time $t_2$ to $t_3$ that transitions the modulation of the switching element 218 back to its original status, which may be to not be modulated at all or may be modulated at a different duty cycle than that used during data transmission. FIG. 7B illustrates that at a no transmission stage 708 between time $t_3$ and $t_4$, no modulation of the switching element 218 may be happening and hence no frequency of modulation is recorded. In other cases, a set frequency may still be used between transmissions of data. Further shown are the next preamble stage 710 and data stage 712. This process may continue with a plurality of different data transmission stages.

Figure 8A:
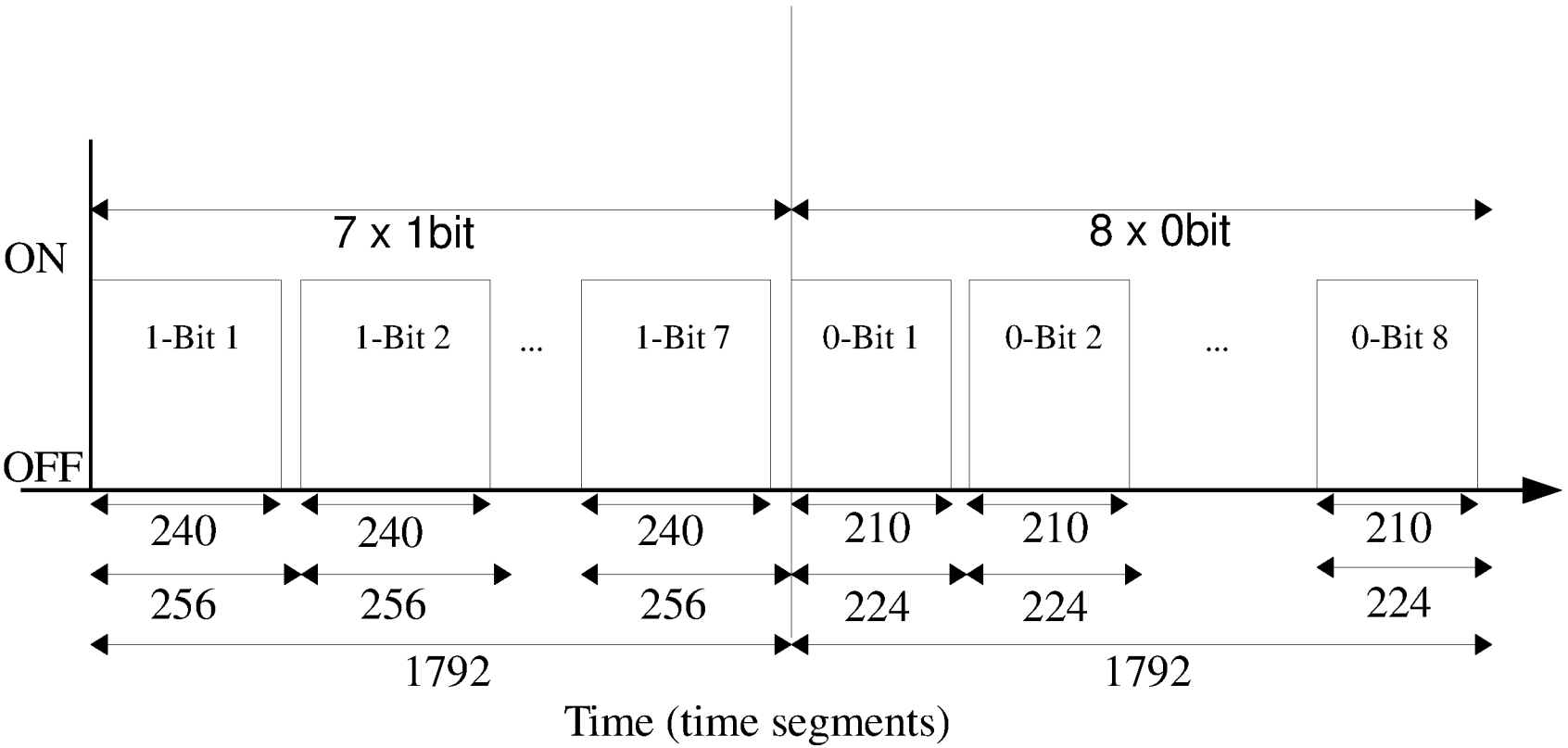
FIG. 8A is a signal diagram for the control of a switching element during communication of a symbol representing a zero bit and a symbol representing a one bit according to a specific implementation.

FIG. 8A is a signal diagram for the control of the switching element 218 during communication of a symbol representing a zero bit and a symbol representing a one bit according to a specific implementation. As illustrated, the "one" fractional-symbol chip is transmitted seven times to form a single symbol representing a one bit and the "zero" fractional-symbol chip is transmitted eight times to form a single symbol representing a zero bit. In this implementation, each of the "one" fractional-symbol chips comprises 240 time segments with the switching element 218 ON or activated and 16 time segment with the switching element 218 OFF or deactivated. Each of the "zero" fractional-symbol chips comprises 210 time segments with the switching element 218 ON or activated and 14 time segment with the switching element 218 OFF or deactivated. In this implementation, each fractional-symbol chip comprises the same duty cycle but with the "one" fractional-symbol chip and the "zero" fractional-symbol chip having different frequencies. The total length of the symbol representing the one bit is 1792 time segments, which is identical to the length of the symbol representing the zero bit.

Figure 8B:
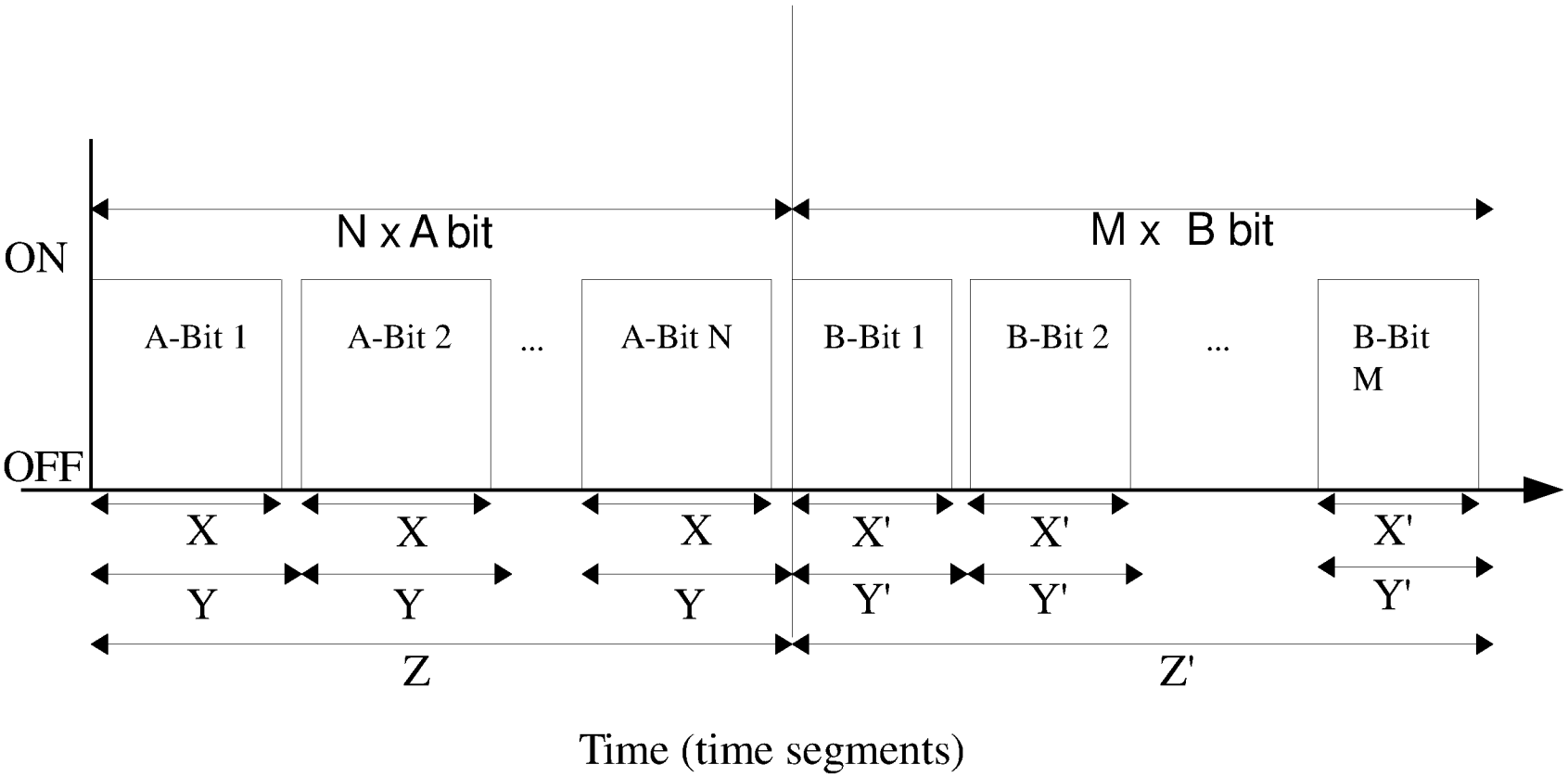
FIG. 8B is a signal diagram for the control of a switching element during communication of a symbol representing a zero bit and a symbol representing a one bit according to a generic implementation.
Figure 9A:
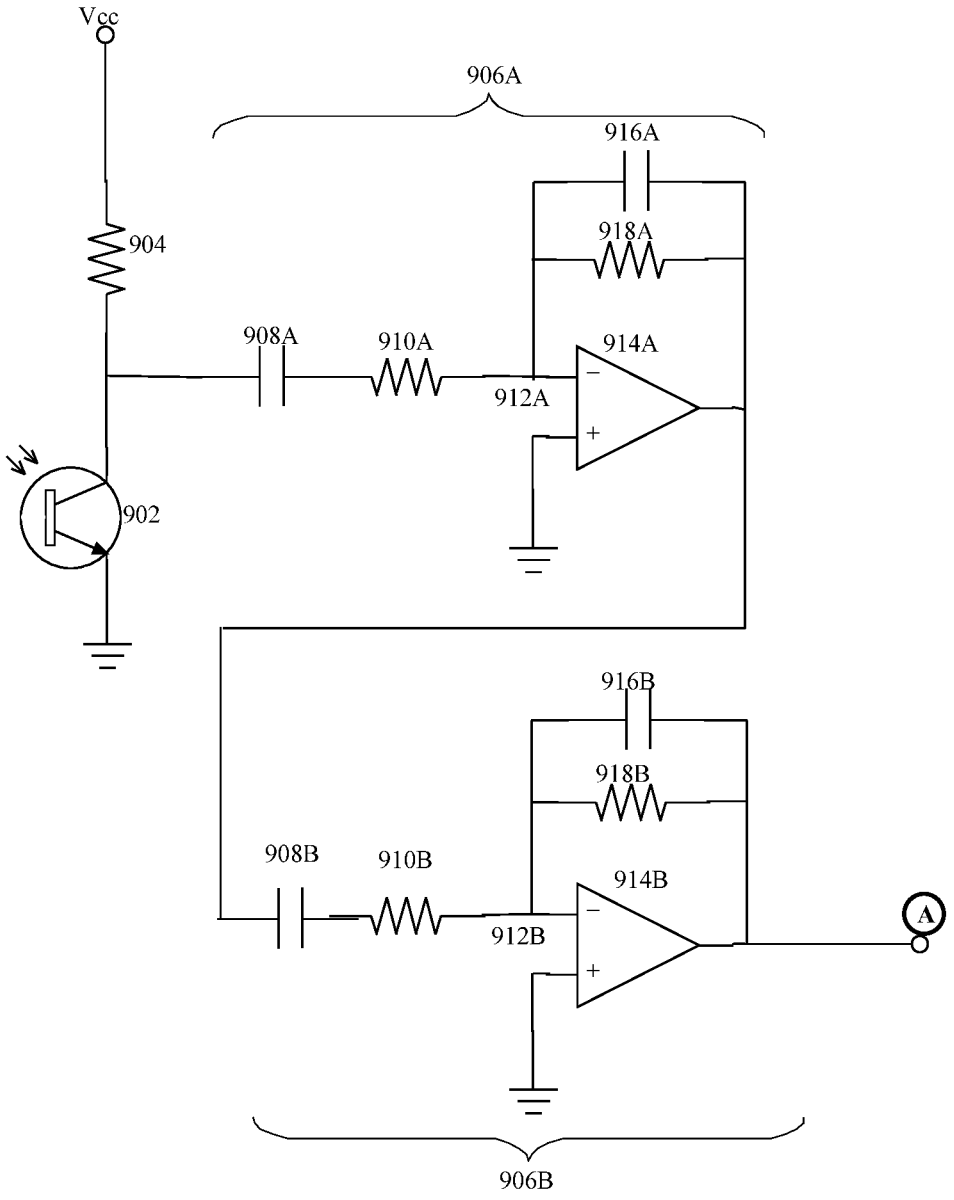
FIGS. 9A and 9B are circuit diagrams for an optical receiver according to one specific implementation.
Figure 9B:
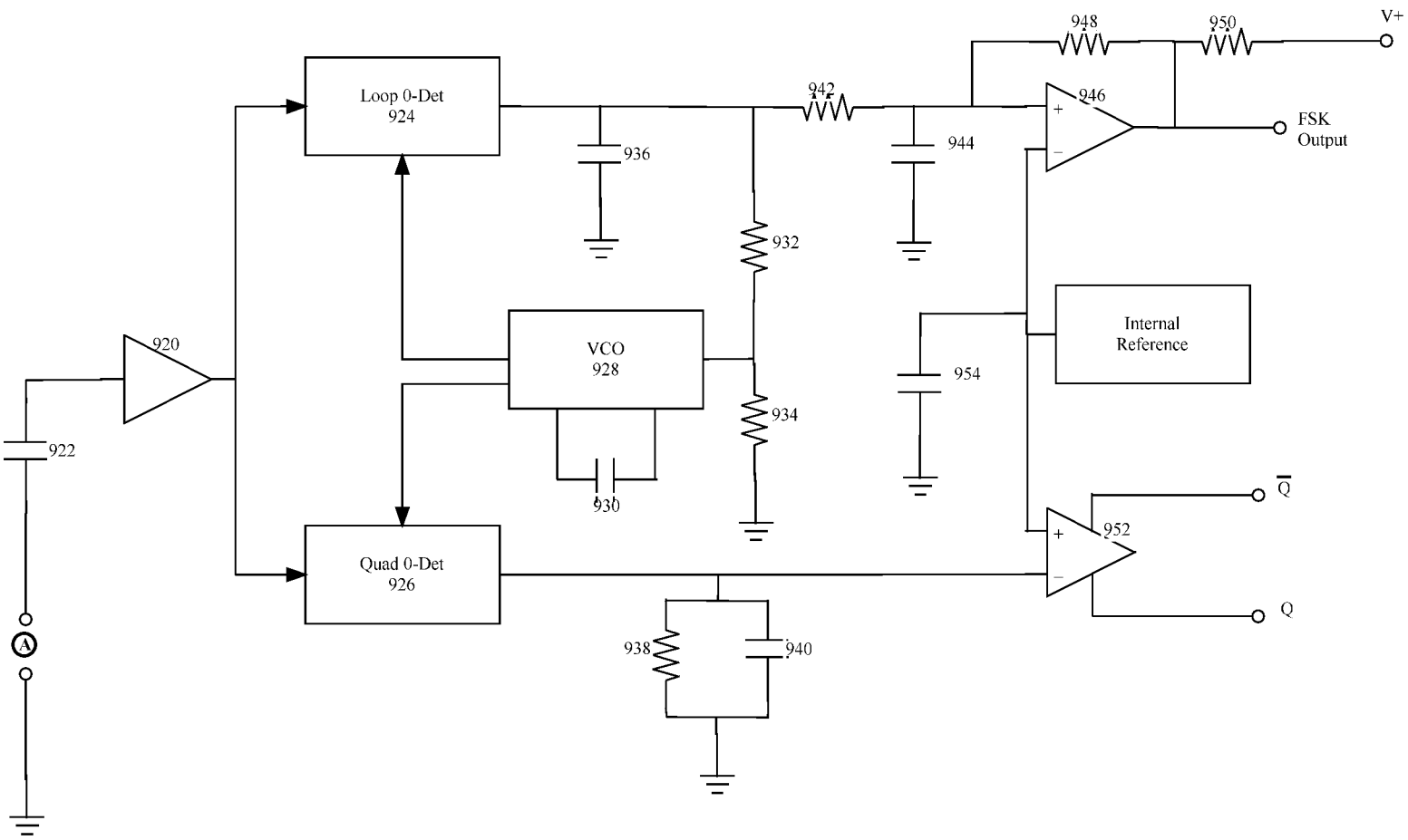

FIG. 8B is a signal diagram for the control of a switching element during communication of a symbol representing an A bit and a symbol representing a B bit according to a generic implementation. As illustrated, the "A" fractional-symbol chip is transmitted N times to form a single symbol representing an A bit and the B fractional-symbol chip is transmitted M times to form a single symbol representing a B bit. In this implementation, each of the "A" fractional-symbol chips comprises X time segments with the switching element 218 ON or activated and Y-X time segment with the switching element 218 OFF or deactivated, where Y is the length of the "A" fractional-symbol chip. Each of the "B" fractional-symbol chips comprises X' time segments with the switching element 218 ON or activated and Y'-X' time segment with the switching element 218 OFF or deactivated, where Y is the length of the "A" fractional-symbol chip. In this implementation, each fractional-symbol chip comprises the same duty cycle but with the "A" fractional-symbol chip and the "B" fractional-symbol chip having different frequencies. The total length of the symbol representing the A bit is $Z=N\times Y$ time segments, which is identical to the length of the symbol representing the B bit equal to $Z'=M\times Y'$. If the implementation requires the two symbols representing the two bits be the same length, then $Z=Z'$ and therefore $N\times Y=M\times Y'$. It should be understood that a wide variety of values could be implemented for variables X, Y, Z and Z', Y', Z'. Further, additional bits of information may be desired to be transmitted. In this case, the system may output more than two bits of data FIGS. 9A and 9B are circuit diagrams for an optical receiver according to one specific implementation. FIG. 9A illustrates a 2-stage amplifier (906A and 906B) with very high gain, fed by a phototransistor 902 (alternatively can be a photodiode) source signal. The DC component is destroyed by the high pass at capacitors 908A, 908B and resistors 910A, 910B, and frequencies above the useful range including noise are minimized by the low-pass portion at capacitors 916A, 916B and resistors 918A, 918B. The output is optimized for the detected signal whilst minimizing noise. FIG. 9B illustrates a fixed frequency detector with outputs of both phase-lock detect 952 and FSK output 946. The capacitor 922 removes the DC component. The frequency and bandwidth of detection are set by the internal VCO 928 and surrounding circuitry. This function is embodied in some available silicon in some implementations such as the NJM2211 by National Japan Radio Company.

Figure 10:
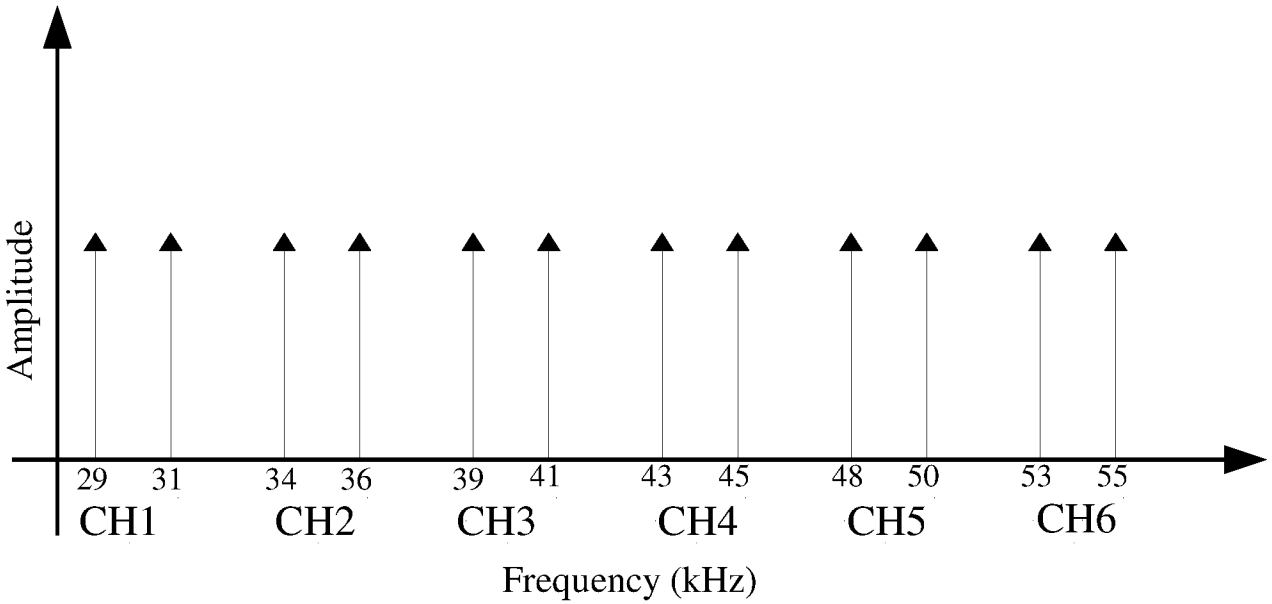
FIG. 10 is a channel diagram illustrating a series of frequency channels that may be used to increase bandwidth of the communications according to one embodiment of the present invention.

In some embodiments of the present invention, a plurality of channels of data may be transmitted using a similar transmission to that depicted in FIGS. 7A, 7B, wherein each channel has a first frequency used to represent a fractional-symbol chip for a first bit and a second frequency used to represent a fractional-symbol chip for a second bit. FIG. 10 is a channel diagram illustrating a series of frequency channels that may be used to increase bandwidth of the communications according to one embodiment of the present invention. As shown, in the example of FIG. 10, a first channel CH1 utilizes frequencies at 29 KHz for a first bit and 31 KHz for a second bit; a second channel CH2 utilizes frequencies at 34 KHz for a first bit and 36 KHz for a second bit; a third channel CH3 utilizes frequencies at 39 KHz for a first bit and 41 KHz for a second bit; a fourth channel CH4 utilizes frequencies at 43 KHz for a first bit and 45 KHz for a second bit; a fifth channel CH5 utilizes frequencies at 48 KHz for a first bit and 50 KHz for a second bit; and a sixth channel CH6 utilizes frequencies at 53 KHz for a first bit and 55 KHz for a second bit. In some embodiments, to remove interference from harmonics, the highest frequency (55 KHz) is less than double of the lowest frequency (29 KHs).

It should be understood that other frequencies described could be utilized in implementing the communication. Further, it should be understood that other components, such as drivers and controllers with alternative implementations, could be used to implement the communication algorithms described. The transmission of data using these algorithms can allow for a robust communication and allow for little to no flicker detectable by a human. The applications for transmission of data in this manner are extensive and may include transmission of diagnostic information about the lighting apparatus, acknowledgements made by the lighting apparatus, transmission of data acquired by the lighting apparatus or transmission of data transmitted to the lighting apparatus.

Although various embodiments of the present invention have been described and illustrated, it will be apparent to those skilled in the art that numerous modifications and variations can be made without departing from the scope of the invention, which is defined in the appended claims.

What is claimed is:

1. A control apparatus adapted to be coupled to a DC power source operable to generate a DC voltage across first and second nodes to maintain a particular current level flowing through a load coupled between the first and second nodes, the particular current level being determined at least in part by a detected resistance between third and fourth nodes within the DC power source, the control apparatus comprising:

a voltage control module adapted to be coupled to the first and second nodes and operable to generate a controlled voltage independent of the DC voltage generated by the DC power source across the first and second nodes; and a control module powered by the controlled voltage and adapted to be coupled to the third and fourth nodes, the control module operable to generate a perceived resistance between the third and fourth nodes;

whereby the control module at least in part controls the particular current level set by the DC power source flowing through the load coupled between the first and second nodes.

2. The control apparatus according to claim 1, wherein the voltage control module comprises a voltage regulator with a maximum input voltage equal to or greater than a maximum voltage output by the DC power source across the first and second nodes.

3. The control apparatus according to claim 2, wherein the second node acts as a virtual ground for the control apparatus and wherein the voltage control module further comprises a capacitor coupled between an output of the voltage regulator and the second node.

4. The control apparatus according to claim 1, wherein the control module comprises an opto isolation element adapted to be coupled between the third and fourth nodes and operable to generate the perceived resistance between the third and fourth nodes.

5. The control apparatus according to claim 4, wherein the opto isolation element comprises an LED and a phototransistor adapted to be coupled between the third and fourth nodes; and wherein the control module is operable to generate a controlled current through the LED, whereby the phototransistor generates the perceived resistance between the third and fourth nodes in response to a light level from the LED dictated by the controlled current.

6. The control apparatus according to claim 5, wherein the control module further comprises a signal generator operable to generate a control signal and a current control module to generate the controlled current through the LED in response to the control signal.

7. The control apparatus according to claim 6, wherein the current control module comprises a buck converter and the control signal is a pulse width modulation signal that controls the buck converter.

8. The control apparatus according to claim 6, wherein the signal generator receives an indication of the current flowing through the LED and generates the control signal at least in part in response to the indication of the current flowing through the LED.

9. The control apparatus according to claim 1, wherein the control module receives an external control signal from a user interface device and generates the perceived resistance between the third and fourth nodes in response to the external control signal.

10. The control apparatus according to claim 9, wherein the external control signal is received via infrared and the user interface device is an infrared remote control device.

11. The control apparatus according to claim 9, wherein the external control signal is received via one of a DMX protocol, ZigBee protocol and DALI protocol system.

12. The control apparatus according to claim 1, wherein the control module receives at least one of an indication of motion and an indication of occupancy and generates the perceived resistance between the third and fourth nodes in response to the at least one of the indication of motion and the indication of occupancy.

13. The control apparatus according to claim 12, wherein, in response to receiving at least one of the indication of motion and the indication of occupancy, the control module is operable to generate a change in the perceived resistance between the third and fourth nodes in order to increase the particular current set by the DC power source.

14. The control apparatus according to claim 12, wherein, in response to not receiving at least one of the indication of motion and the indication of occupancy for a predetermined time, the control module is operable to generate a change in the perceived resistance between the third and fourth nodes in order to decrease the particular current set by the DC power source.

15. The control apparatus according to claim 1 further comprising a switching element adapted to be coupled between the DC power source and the load, the switching element operable to connect the DC power source and the load during a first state and to disconnect the DC power source and the load during a second state; wherein the control module controls the state of the switching element and dictates whether the switching element is in the first or second state.

16. The control apparatus according to claim 15, wherein the first and second nodes are coupled to high and low power outputs respectively of the DC power source; and wherein the switching element is an N-channel transistor and is coupled between the second node and the load.

17. The control apparatus according to claim 15, wherein the first and second nodes are coupled to high and low power outputs respectively of the DC power source; and wherein the switching element is a P-channel transistor and is coupled between the first node and the load.

18. The control apparatus according to claim 15, wherein the control module receives an external control signal from a user interface device and controls the state of the switching element in response to the external control signal.

19. The control apparatus according to claim 15, wherein the control module receives at least one of an indication of motion and an indication of occupancy and controls the state of the switching element in response to the at least one of the indication of motion and the indication of occupancy.

20. The control apparatus according to claim 19, wherein, in response to receiving at least one of the indication of motion and the indication of occupancy, the control module is operable to control the switching element to be in the first state.

21. The control apparatus according to claim 19, wherein, in response to not receiving at least one of the indication of motion and the indication of occupancy for a predetermined time, the control module is operable to control the switching element to be in the second state.

22. The control apparatus according to claim 15, wherein the control module comprises a light sensor; and wherein the control module is operable to control the switching element to be in the first state for a first period of time and to be in the second state for a second period of time; to measure light using the light sensor during the second period of time; and generate the perceived resistance between the third and fourth nodes at least in part in response to the measured light during the second time period.

23. The control apparatus according to claim 22, wherein the control module controls the switching element to be in the first state substantially longer than the second state, whereby the DC power source is not substantially affected by the switching of the switching element.

24. An apparatus comprising:

a DC power source operable to generate a DC voltage across first and second nodes to maintain a particular current level flowing through a load coupled between the first and second nodes, the particular current level being determined at least in part by a detected resistance between third and fourth nodes within the DC power source; and a control apparatus adapted to be coupled to the first and second nodes and operable to generate a controlled voltage independent of the DC voltage generated by the DC power source across the first and second nodes; the control apparatus comprising a control module powered by the controlled voltage and adapted to be coupled to the third and fourth nodes, the control module operable to generate a perceived resistance between the third and fourth nodes;

whereby the control module at least in part controls the particular current level set by the DC power source flowing through the load coupled between the first and second nodes.

25. A lighting apparatus comprising:

a lighting module coupled between first and second nodes;

a DC power source operable to generate a DC voltage across the first and second nodes to maintain a particular current level flowing through the lighting module, the particular current level being determined at least in part by a detected resistance between third and fourth nodes within the DC power source; and a control apparatus adapted to be coupled to the first and second nodes and operable to generate a controlled voltage independent of the DC voltage generated by the DC power source across the first and second nodes; the control apparatus comprising a control module powered by the controlled voltage and adapted to be coupled to the third and fourth nodes, the control module operable to generate a perceived resistance between the third and fourth nodes;

whereby the control apparatus at least in part controls the particular current level set by the DC power source flowing through the lighting module.

* * * * *